US011335490B2

(12) United States Patent
Nishiguchi et al.

(10) Patent No.: US 11,335,490 B2
(45) Date of Patent: May 17, 2022

(54) SOLENOID DEVICE

(71) Applicants: SOKEN, INC., Nisshin (JP); DENSO CORPORATION, Kariya (JP); DENSO ELECTRONICS CORPORATION, Anjo (JP)

(72) Inventors: Yoshitaka Nishiguchi, Nisshin (JP); Takahiro Soki, Kariya (JP); Masanao Sugisawa, Anjo (JP)

(73) Assignees: SOKEN, INC., Nisshin (JP); DENSO CORPORATION, Kariya (JP); DENSO ELECTRONICS CORPORATION, Anjo (JP)

( * ) Notice: Subject to any disclaimer, the term of this patent is extended or adjusted under 35 U.S.C. 154(b) by 116 days.

(21) Appl. No.: 16/871,332

(22) Filed: May 11, 2020

(65) Prior Publication Data

US 2020/0273615 A1 Aug. 27, 2020

Related U.S. Application Data

(63) Continuation of application No. PCT/JP2018/041422, filed on Nov. 8, 2018.

(30) Foreign Application Priority Data

Nov. 9, 2017 (JP) ..... JP2017-216193

(51) Int. Cl.
*H01F 3/00* (2006.01)
*H01F 7/16* (2006.01)
(Continued)

(52) U.S. Cl.
CPC ..... *H01F 7/16* (2013.01); *H01F 7/081* (2013.01); *H01F 27/24* (2013.01); *H01F 27/28* (2013.01); *H01F 2007/086* (2013.01)

(58) Field of Classification Search
CPC . H01F 7/16; H01F 7/081; H01F 27/24; H01F 27/28; H01F 2007/086; H01F 7/121; H01F 7/1638
(Continued)

(56) References Cited

U.S. PATENT DOCUMENTS

2012/0105178 A1 5/2012 Niimi
2018/0247781 A1* 8/2018 Nishiguchi ..... H01H 50/36
(Continued)

FOREIGN PATENT DOCUMENTS

JP 2015-162537 A 9/2015

*Primary Examiner* — Shawki S Ismail
*Assistant Examiner* — Lisa N Homza
(74) *Attorney, Agent, or Firm* — Oliff PLC

(57) ABSTRACT

An electromagnetic coil through which current is passed to generate a magnetic flux, a fixed core, a movable core, a magnetic spring disposed between the cores and, and a yoke are provided. The magnetic spring includes a magnetic substance, and biases the movable core in a direction in which the movable core is separated from the fixed core in a Z direction. Additionally, the magnetic spring includes a leaf spring member including the magnetic substance and spirally wound, and a central portion of the magnetic spring is located biased toward one side in the Z direction compared to a peripheral portion of the magnetic spring. When the movable core is attracted to the access position, the magnetic spring is prevented from being deformed to a minimum spring length corresponding to a width of the leaf spring member.

9 Claims, 26 Drawing Sheets

(51) Int. Cl.
*H01F 7/08* (2006.01)
*H01F 27/24* (2006.01)
*H01F 27/28* (2006.01)

(58) Field of Classification Search
USPC ..... 335/281
See application file for complete search history.

(56) References Cited

U.S. PATENT DOCUMENTS

| | | | | |
|---|---|---|---|---|
| 2019/0221392 | A1* | 7/2019 | Nishiguchi | H01H 50/443 |
| 2019/0295796 | A1* | 9/2019 | Sugisawa | H01H 50/546 |
| 2020/0035433 | A1* | 1/2020 | Nishiguchi | H01H 9/446 |
| 2020/0273615 | A1* | 8/2020 | Nishiguchi | H01F 7/16 |
| 2020/0381204 | A1* | 12/2020 | Sugisawa | H01H 1/32 |

* cited by examiner

SOLENOID DEVICE

CROSS-REFERENCE TO RELATED APPLICATION

This application is the U.S. bypass application of International Application No. PCT/JP2018/041422 filed Nov. 8, 2018 which designated the U.S. and claims priority to Japanese Patent Application No. 2017-216193, filed Nov. 9, 2017, the contents of both of which are incorporated herein by reference.

TECHNICAL FIELD

The present disclosure relates to a solenoid device including an electromagnetic coil and a movable core performing reciprocation depending on whether current is passed the electromagnetic coil.

BACKGROUND

In the related art, a solenoid device is known that includes an electromagnetic coil and a movable core performing reciprocation depending on whether current is passed the electromagnetic coil (see JP 2015-162537 A, for example). In the solenoid device, the electromagnetic coil is internally provided with a fixed core including a magnetic substance. Additionally, a spring member is provided between the fixed core and the movable core. The spring member urges the movable core in a direction away from the fixed core along an axial direction of the electromagnetic coil.

SUMMARY

An aspect of the present disclosure includes a solenoid device including:

an electromagnetic coil through which current is passed to generate a magnetic flux, a fixed core disposed in the electromagnetic coil, a movable core performing reciprocation in an axial direction of the electromagnetic coil depending on whether current is passed the electromagnetic coil, a magnetic spring disposed between the fixed core and the movable core and including a magnetic substance, the magnetic spring biasing the movable core in a direction away from the fixed core in the axial direction, and a yoke included in a magnetic circuit in which the magnet flux flows, the magnetic circuit also including the magnetic spring, the movable core, and the fixed core, wherein when current is passed the electromagnetic coil, the movable core is attracted to an access position by an electromagnetic force against a spring force of the magnetic spring, the access position being relatively close to the fixed core, the electromagnetic force resulting from the conduction of current, and when the conduction of current through the electromagnetic coil is stopped, the movable core is moved to a separation position by the spring force of the magnetic spring, the separation position being farther from the fixed core than the access position, the magnetic spring includes a leaf spring member including the magnetic substance and spirally wound such that a thickness direction of the leaf spring member coincides with a radial direction of the electromagnetic coil, a central portion of the magnetic spring is located on one side in the axial direction with respect to a peripheral portion of the magnetic spring, and when the movable core is attracted to the access position, the magnetic spring is prevented from being deformed to a minimum spring length corresponding to a width of the leaf spring member in the axial direction.

BRIEF DESCRIPTION OF THE DRAWINGS

The above objects and other objects, features and advantages of the present disclosure will be made clearer by the following detailed description, given referring to the appended drawings. In the accompanying drawings.

DETAILED DESCRIPTION OF THE PREFERRED EMBODIMENTS

When current is passed the electromagnetic coil, a magnetic flux flows and generates an electromagnetic force to cause the movable core to be attracted to the fixed core against a pressing force of the spring member. Additionally, when the conduction of current through the electromagnetic coil is stopped, the electromagnetic force is eliminated, and the movable core is separated from the fixed core by the pressing force of the spring member. The solenoid device thus causes the movable core to perform reciprocation depending on whether current is passed the electromagnetic coil.

The spring member includes a nonmagnetic substance. Thus, a portion of the solenoid device in which the spring member is disposed offers high magnetic resistance, and the movable core is not attracted by a sufficiently strong force unless a large current is passed through the electromagnetic coil.

Figure 4:
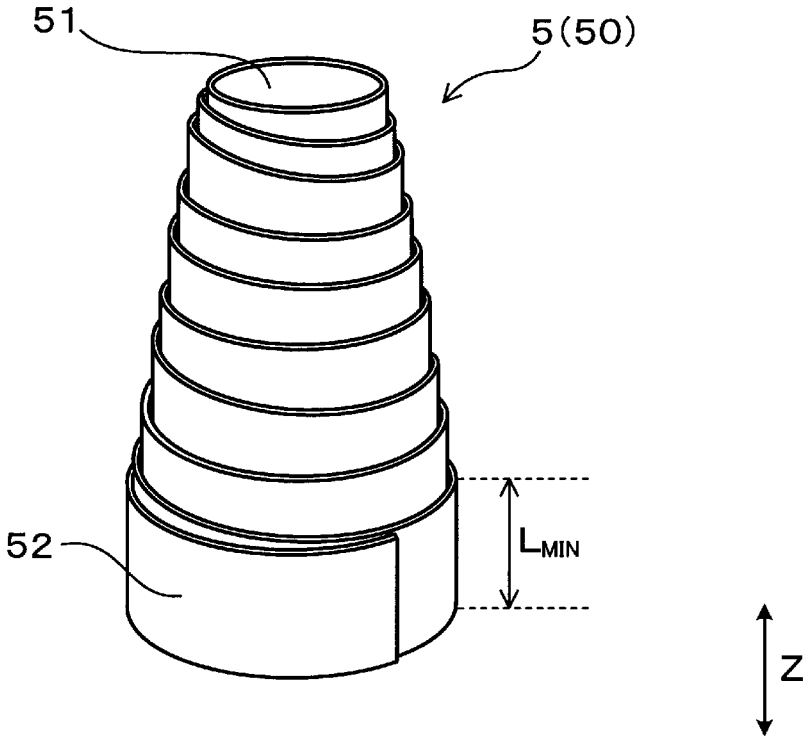
FIG. 4 is a perspective view of a magnetic spring to which no force is applied according to the first embodiment.

To solve this problem, studies have recently been conducted on formation of the spring member using a magnetic substance. In particular, studies have been conducted on the use of a spring member (hereinafter also referred to as a magnetic spring: see FIG. 4) formed by spirally winding a leaf spring formed of a magnetic substance, the spring member being shaped such that, with no force applied in an axial direction, a central portion of the spring member is located biased toward one side in an axial direction compared to a peripheral portion of the spring member. The use of such a magnetic spring allows for a reduction in magnetic resistance of the portion with the magnetic spring disposed therein (that is, the portion between the fixed core and the movable core). It is thus expected that a magnetic flux flows more easily through the electromagnetic coil and that the movable core can be attracted by a strong force even with a small amount of current passed through the electromagnetic coil.

The above-described solenoid device involves a difference in attraction force among individual solenoid devices. Specifically, in the above-described solenoid device, when the movable core is attracted, the magnetic spring is deformed to the width of the above-described leaf spring (in other words, the minimum spring length of the magnetic spring). When an axial force is applied to the magnetic spring having a natural length, the spring length gradually decreases, while the spring force gradually increases (see FIG. 6). In a case where the magnetic spring is sufficiently longer than the minimum spring length, the amount of displacement from the natural length and the spring force are in a substantially proportional relationship. However, near the minimum spring length, the spring force increases rapidly. Additionally, near the minimum spring length, the spring force varies among products. Additionally, deformation of the magnetic spring to the minimum spring length leads to a significant variation in spring force among products, and thus the attraction force (that is, the force obtained by subtracting the spring force of the magnetic spring from an electromagnetic force resulting from conduction of current through the electromagnetic coil) of the movable core is likely to vary. Thus, the attraction may be insufficient, precluding the movable core from being attracted or significantly varying the speed at which the movable core is attracted.

An object of the present disclosure is to provide a solenoid device that can reduce variation in attraction force of the movable core among products.

An aspect of a solenoid device includes an electromagnetic coil through which current is passed to generate a magnetic flux, a fixed core disposed in the electromagnetic coil, a movable core performing reciprocation in an axial direction of the electromagnetic coil depending on whether current is passed the electromagnetic coil, a magnetic spring disposed between the fixed core and the movable core and including a magnetic substance, the magnetic spring biasing the movable core in a direction away from the fixed core in the axial direction, and a yoke included in a magnetic circuit in which the magnet flux flows, the magnetic circuit also including the magnetic spring, the movable core, and the fixed core.

When current is passed the electromagnetic coil, the movable core is attracted to an access position by an electromagnetic force against a spring force of the magnetic spring, the access position being relatively close to the fixed core, the electromagnetic force resulting from the conduction of current, and when the conduction of current through the electromagnetic coil is stopped, the movable core is moved to a separation position by the spring force of the magnetic spring, the separation position being farther from the fixed core than the access position.

The magnetic spring includes a leaf spring member including the magnetic substance and spirally wound such that a thickness direction of the leaf spring member coincides with a radial direction of the electromagnetic coil, a central portion of the magnetic spring is located on one side in the axial direction with respect to a peripheral portion of the magnetic spring.

When the movable core is attracted to the access position, the magnetic spring is prevented from being deformed to a minimum spring length corresponding to a width of the leaf spring member in the axial direction.

The solenoid device is configured such that, when the movable core is attracted to the access position, the magnetic spring is prevented from being deformed to the minimum spring length.

This eliminates a need for the use of an area (near the minimum spring length) of the magnetic spring that involves variation in spring force among products, allowing suppression of variation in attraction force of the movable core (that is, the force obtained by subtracting the spring force of the magnetic spring from an electromagnetic force resulting from conduction of current through the electromagnetic coil). Accordingly, the solenoid device enables prevention of a failure to suck the movable core resulting from insufficiency of the attraction force and also allows suppression of significant variation in attraction speed of the movable core.

As described above, according to the above-described aspect, a solenoid device can be provided that can reduce variation in attraction force of the movable core among products.

First Embodiment

Figure 1:
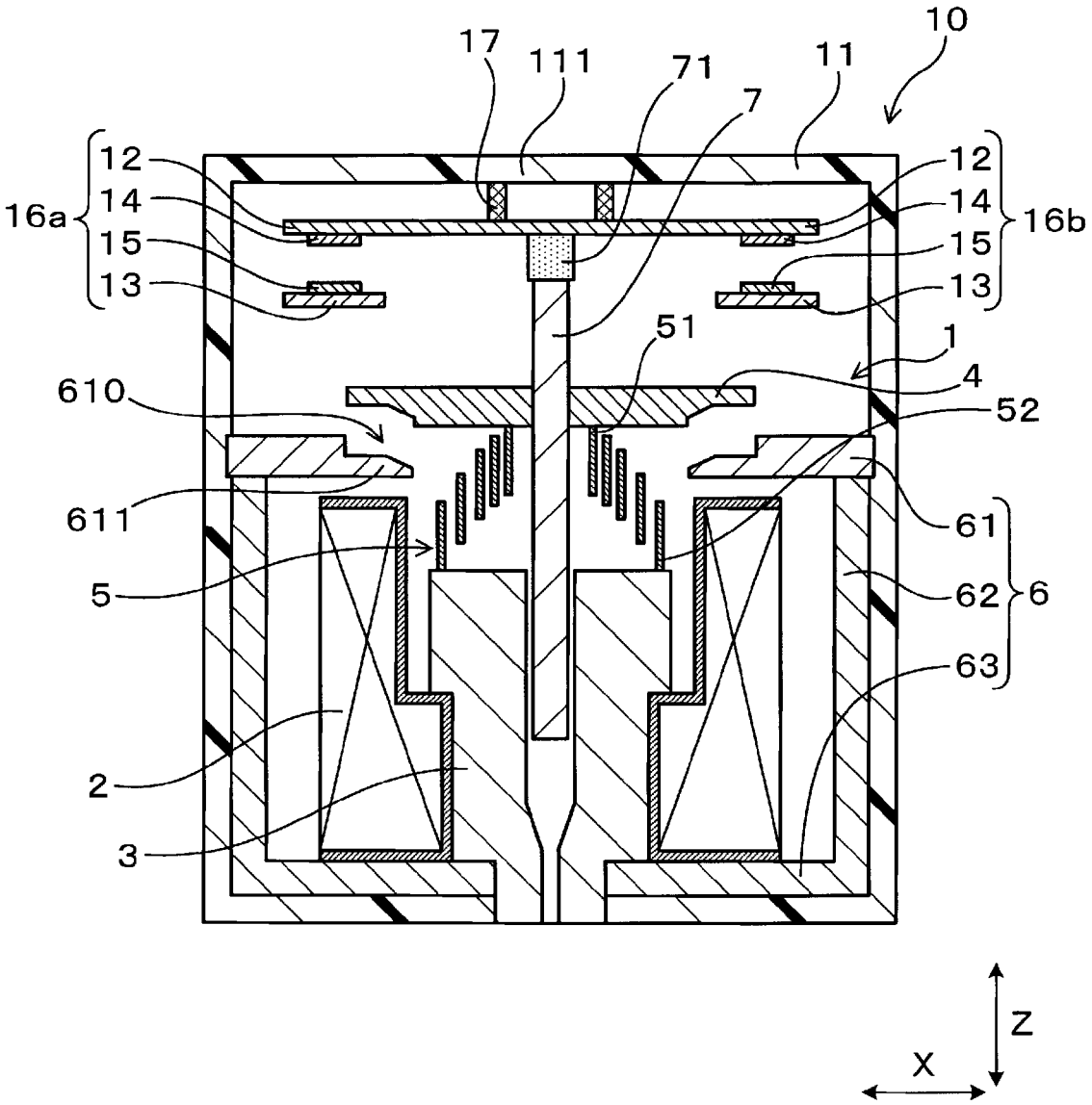
FIG. 1 is a cross-sectional view of a solenoid device in a state in which no current is passed an electromagnetic coil according to a first embodiment.
Figure 2:
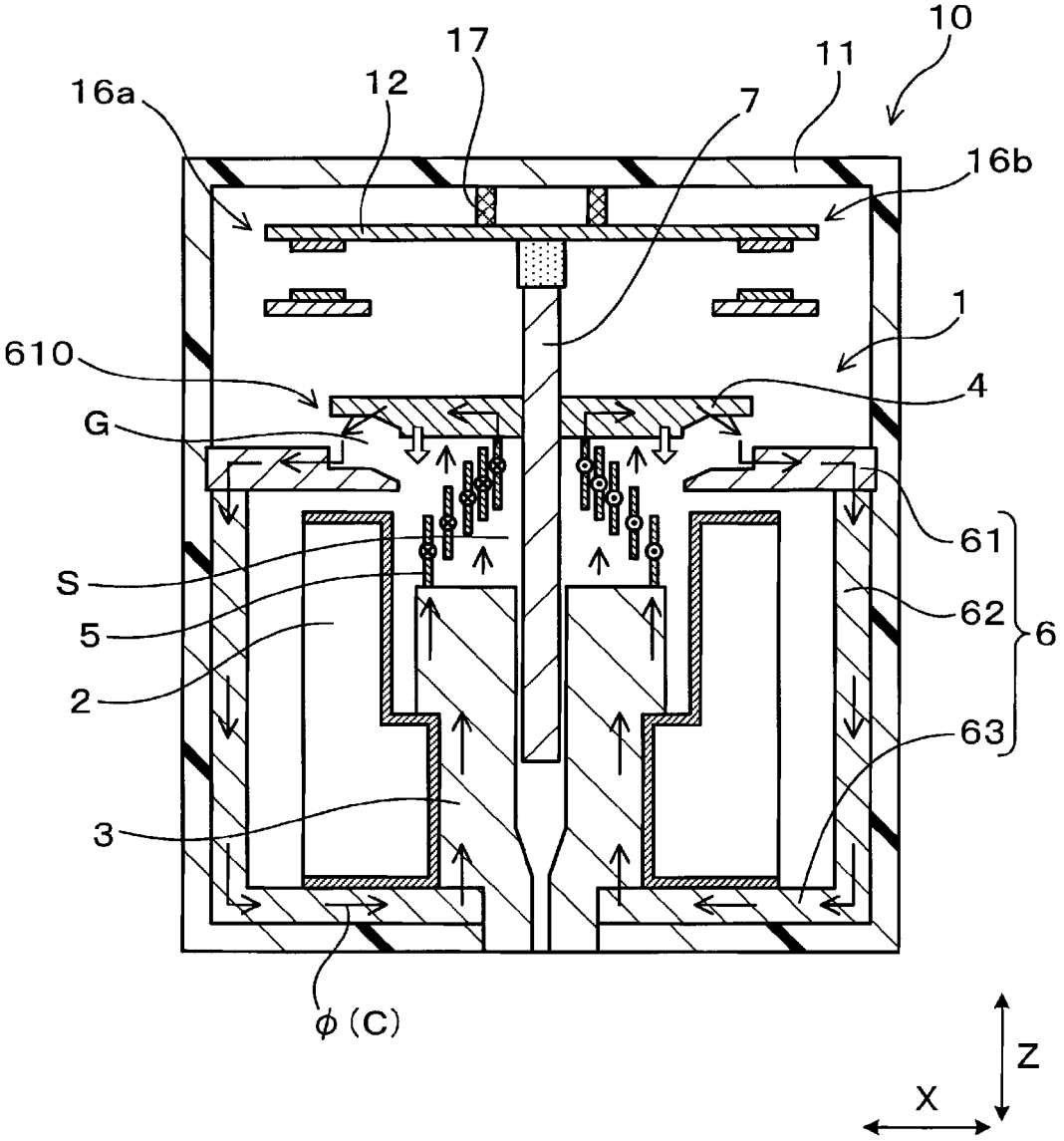
FIG. 2 is a cross-sectional view of the solenoid device immediately after current is passed the electromagnetic coil according to the first embodiment.
Figure 3:
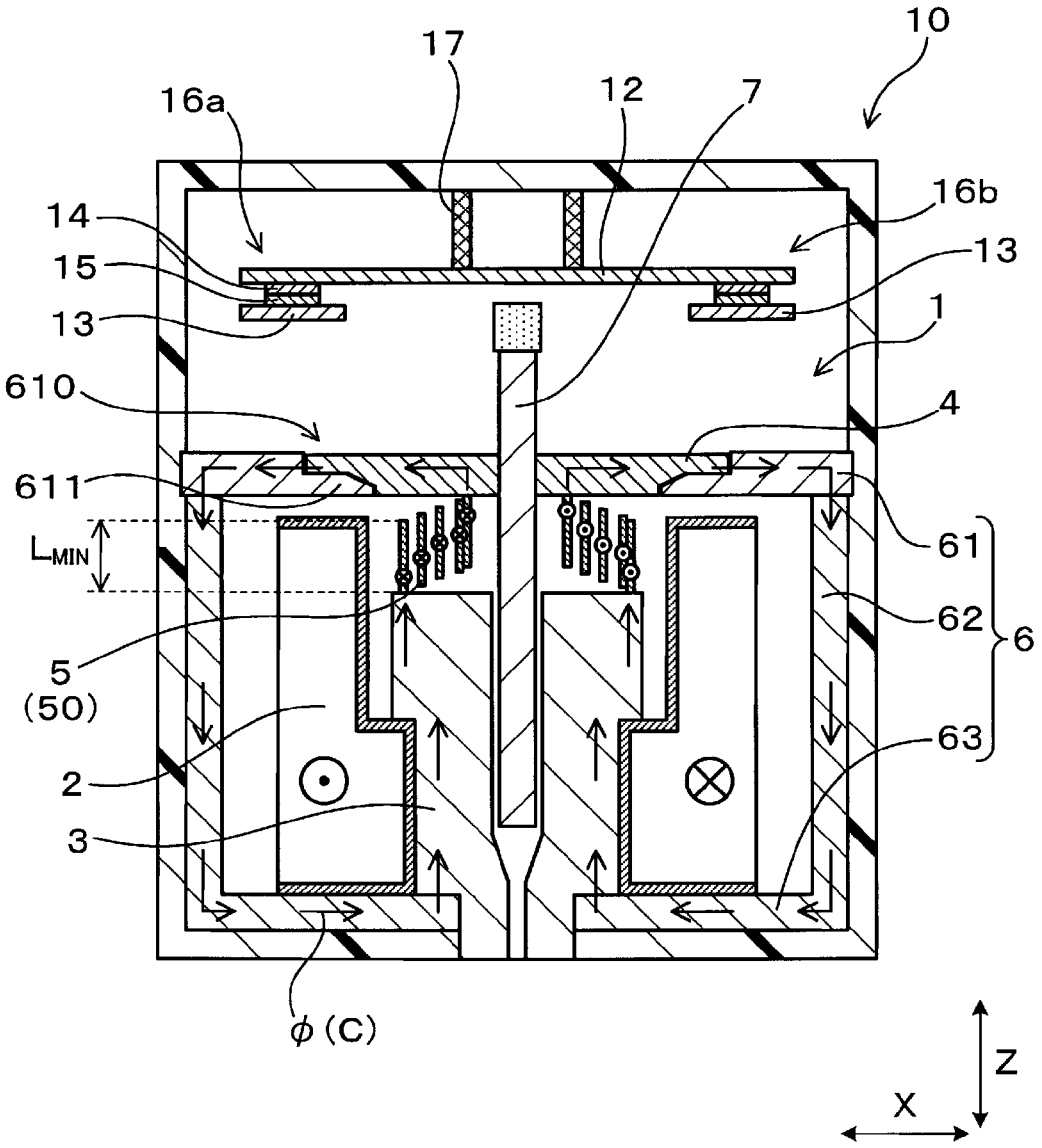
FIG. 3 is a cross-sectional view of a solenoid device in a state in which current is passed an electromagnetic coil according to the first embodiment.

Embodiments related to the above-described solenoid device will be described with reference to FIGS. 1 to 11. As illustrated in FIGS. 1 to 3, a solenoid device 1 according to the present embodiment includes an electromagnetic coil 2 through which current is passed to generate a magnetic flux ϕ, a fixed core 3, a movable core 4, a magnetic spring 5, and a yoke 6. The fixed core 3 is disposed in the electromagnetic coil 2. The movable core 4 performs reciprocation in an axial direction (Z direction) of the electromagnetic coil 2 depending on whether current is passed the electromagnetic coil 2.

The magnetic spring 5 is disposed between the fixed core 3 and the movable core 4. The magnetic spring 5 includes a magnetic substance, and biases the movable core 4 in a direction away from the fixed core 3 in a Z direction. The yoke 6, along with the magnetic spring 5, the movable core 4, and the fixed core 3, constitutes a magnetic circuit C through which a magnetic flux ϕ flows.

As illustrated in FIG. 3, when current is passed the electromagnetic coil 2, the movable core 4 is attracted to an access position by an electromagnetic force against a spring force of the magnetic spring 5, the access position being relatively close to the fixed core 3, the electromagnetic force resulting from the conduction of current. Additionally, as illustrated in FIG. 1, when the supply of current through the electromagnetic coil 2 is stopped, the movable core 4 is moved to a separation position by the spring force of the magnetic spring 5, the separation position being farther from the fixed core 3 than the access position.

Figure 5:
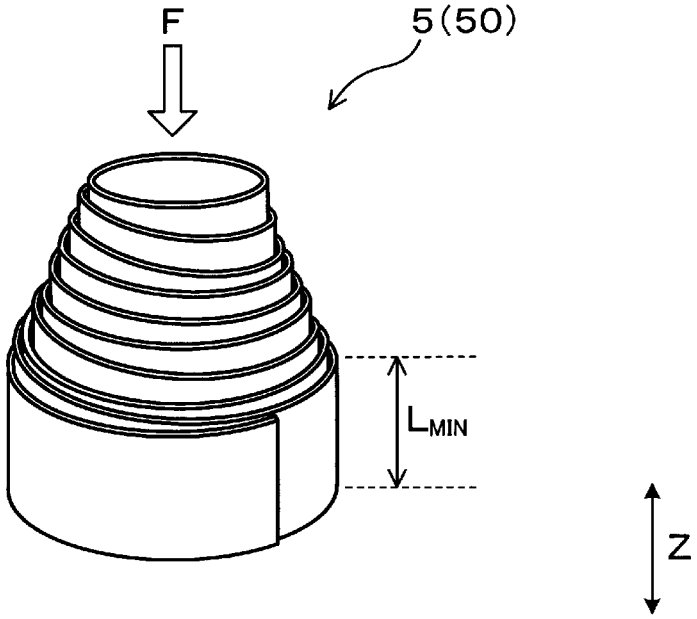
FIG. 5 is a perspective view of the magnetic spring to which a force is applied in an axial direction.

As illustrated in FIG. 1 and FIG. 5, the magnetic spring 5 is formed by spirally winding a leaf spring member 50 including a magnetic substance such that a thickness direction of the leaf spring member 50 coincides with a radial direction of the electromagnetic coil 2, and a central portion 51 of the magnetic spring 5 is located biased toward one side in a Z direction compared to a peripheral portion 52 of the magnetic spring 5.

As illustrated in FIG. 3, when the movable core 4 is attracted to the access position, the magnetic spring 5 is prevented from being deformed to a minimum spring length $L_{MIN}$ corresponding to the width of the leaf spring member 50

The solenoid device 1 according to the present embodiment is used in an electromagnetic relay 10. As illustrated in FIG. 1, the electromagnetic relay 10 includes a switch 16 (16$_a$ and 16$_b$). Forward and backward moving operations of the movable core 4 turn on and off the switch 16.

As illustrated in FIG. 1, the solenoid device 1 includes a shaft 7 inserted into the fixed core 3. The shaft 7 is formed of a nonmagnetic substance. A tip 71 of the shaft 7 is formed of an insulating material.

Figure 7:
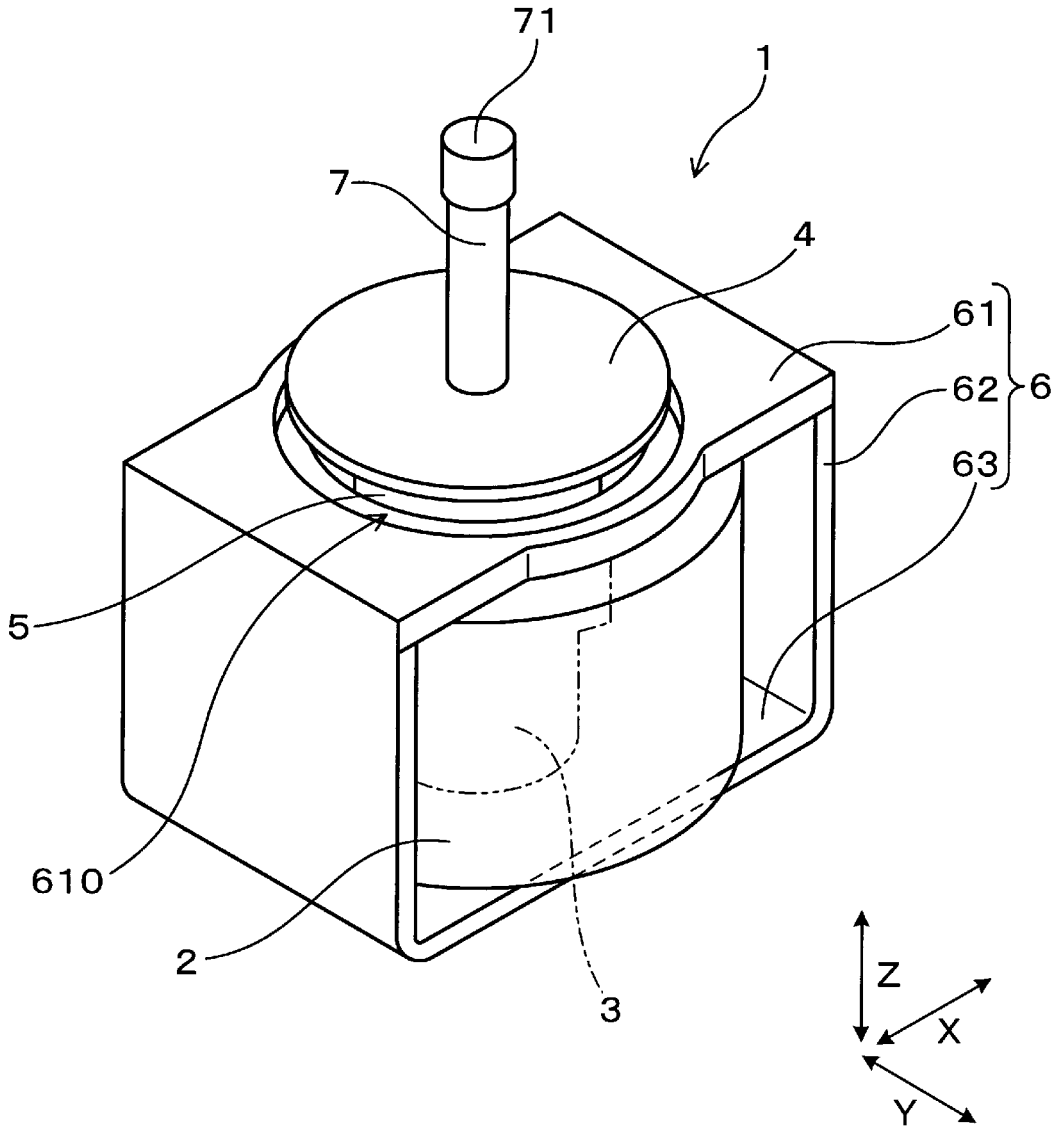
FIG. 7 is a perspective view of the solenoid device according to the first embodiment.

As illustrated in FIG. 1 and FIG. 7, the yoke 6 includes a bottom wall portion 63, a side wall portion 62, and an upper wall portion 61. The upper wall portion 61 is provided with a through-hole 610. The movable core 4 is fitted into the through-hole 610. As illustrated in FIG. 3, an inner surface of the through-hole 610 is provided with a stopper 611 that stops the movable core 4 at the access position.

As illustrated in FIG. 1, the electromagnetic relay 10 includes a fixed conductive unit 13, a movable conductive unit 12, a fixed side contact 15 formed on the fixed conductive unit 13, and a movable side contact 14 formed on the movable conductive unit 12. The conductive units 12 and 13 and the contacts 14 and 15 are included in the switch 16 (16$_a$ and 16$_b$). A switch side spring member 17 is provided between the movable conductive unit 12 and a wall portion 111 of a case 11. The switch side spring member 17 is used to press the movable conductive unit 12 toward the fixed core 3 in the Z direction.

As illustrated in FIG. 1, with the conduction of current through the electromagnetic coil 2 stopped, the movable core 4 is pressed by the spring force of the magnetic spring 5 to move to the separation position. At this time, the tip 71 of the shaft 7 comes into contact with the movable conductive unit 12 to press the movable conductive unit 12 against a pressing force of the switch side spring member 17. Thus, the contacts 14 and 15 leave each other to turn off the switch 16.

Additionally, as illustrated in FIG. 2, when the conduction of current through the electromagnetic coil 2 is started, a magnetic flux ϕ is generated. The magnetic flux ϕ flows from the fixed core 3 to the magnetic spring 5 and then through the movable core 4, a gap G, and the yoke 6. A portion of the magnetic flux ϕ also flows through a space S between the fixed core 3 and the magnetic spring 5. Similarly, the magnetic flux ϕ flows through a space between the movable core 4 and the magnetic spring 5. The magnetic flux ϕ flows as described above to generate an electromagnetic force, sucking the movable core 4 against the pressing force of the magnetic spring 5 as illustrated in FIG. 3. The movable core 4 comes into contact with the stopper 611 and is stopped.

When the movable core 4 is attracted as described above, the shaft 7 is also attracted toward the fixed core 3. Thus, the pressing force of the switch side spring member 17 presses the movable conductive unit 12 toward the fixed core 3, turning on the switch 16 (16$_a$, 16$_b$).

Figure 6:
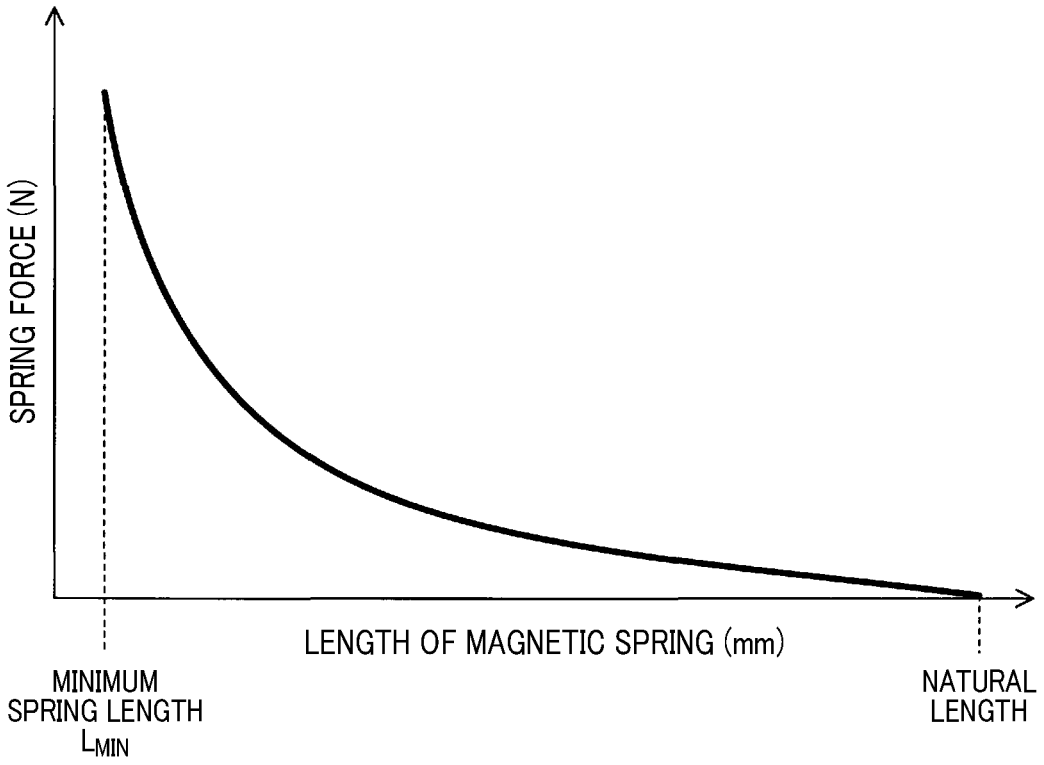
FIG. 6 is a graph illustrating a relationship between the spring length and spring force of the magnetic spring according to the first embodiment.

Now, a relationship between the length and the spring force of the magnetic spring 5 will be described. As illustrated in FIG. 6, when a force is applied, in the Z direction, to the magnetic spring 5 having a natural length, the spring length gradually increases to increase the spring force. In a case where the magnetic spring 5 is sufficiently longer than a minimum spring length $L_{MIN}$, the amount of displacement from the natural length and the spring force are in a substantially proportional relationship. However, near the minimum spring length $L_{MIN}$, the spring force rapidly increases. Additionally, the spring force near the minimum spring length $L_{MIN}$ involves a significant manufacturing variation. Thus, in a case where the magnetic spring 5 is deformed to the minimum spring length $L_{MIN}$ when the movable core 4 (see FIG. 3) is attracted, the significant manufacturing variation in spring force may prevent the movable core 4 from being sufficiently attracted or reduce the speed at which the movable core 4 is attracted. However, in the present embodiment, the magnetic spring 5 is not deformed to the minimum spring length $L_{MIN}$ (see FIG. 3), the above-described effects of the variation in spring force are less likely to be produced. Thus, the movable core 4 can be reliably attracted to the access position. Additionally, variation in speed at which the movable core 4 is attracted can be suppressed. Furthermore, in the present embodiment, the area of the magnetic spring 5 can be exclusively used where the amount of displacement and the spring force are substantially proportional (see FIG. 6), thus facilitating design of the magnetic spring 5.

Figure 8:
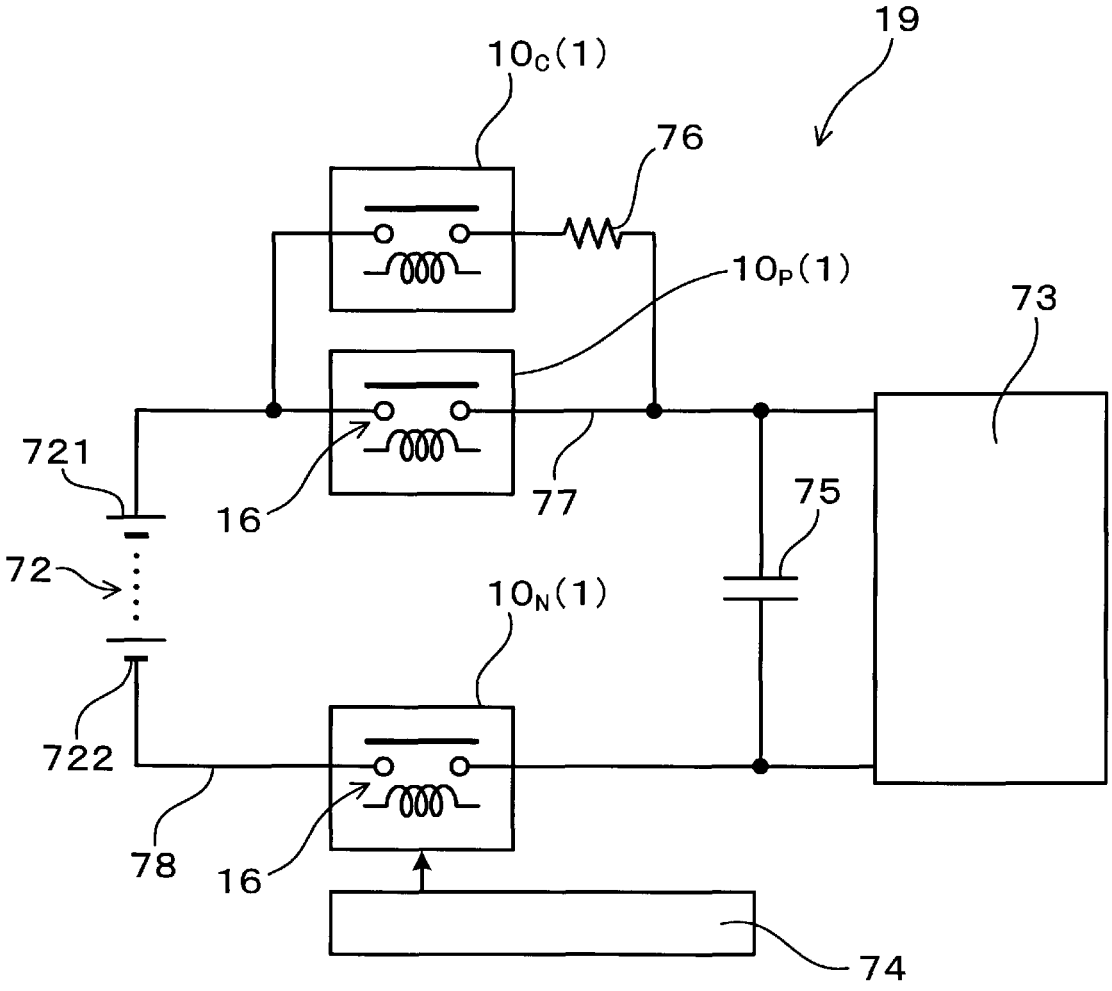
FIG. 8 is a diagram illustrating operations of a relay system using the solenoid device according to the first embodiment.

Now, a method for using the electromagnetic relay 10 will be described. As illustrated in FIG. 8, in the present embodiment, a relay system 19 is configured using the electromagnetic relay 10. The relay system 19 includes three electromagnetic relays 10, a DC power supply 72, a smoothing capacitor 75, electric equipment 73, a precharge resistor 76, and a control unit 74. The control unit 74 controls on/off operations of the individual electromagnetic relays 10.

A positive side electromagnetic relay $\mathbf{10}_P$ is provided on positive-side wiring 77 connecting a positive electrode 721 of a DC power supply 72 and the electric equipment 73. Additionally, a negative side electromagnetic relay $\mathbf{10}_N$ is provided on negative-side wiring 78 connecting a negative electrode 722 of the DC power supply 72 and the electric equipment 73. Furthermore, a precharge electromagnetic relay $\mathbf{10}_C$ is provided in series with the precharge resistor 76.

Figure 9:
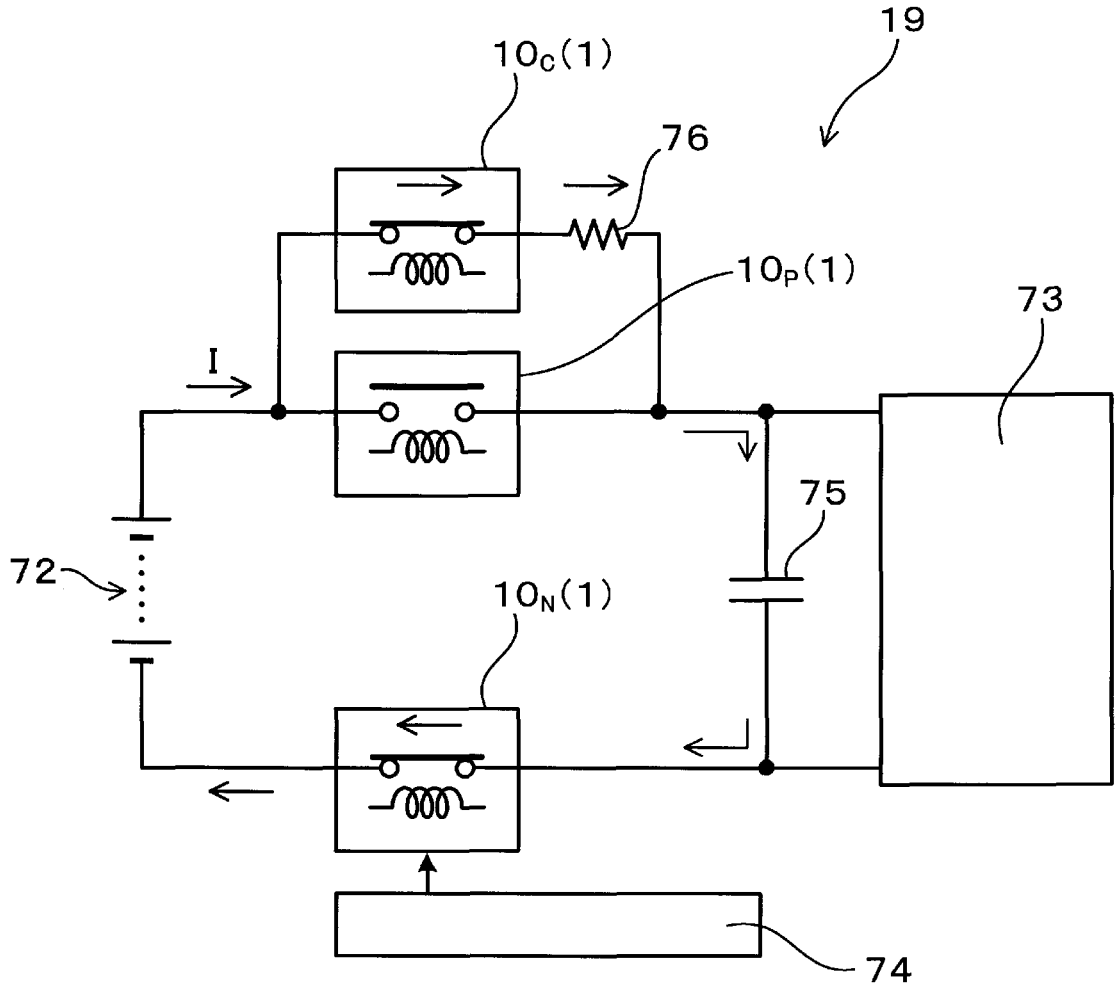
FIG. 9 is a diagram following FIG. 8.

When both the positive-side electromagnetic relay $\mathbf{10}_P$ and the negative-side electromagnetic relay $\mathbf{10}_N$ are turned on with the smoothing capacitor 75 uncharged, an inrush current may flow through the smoothing capacitor 75 to weld the switch 16. Thus, as illustrated in FIG. 9, the precharge electromagnetic relay $\mathbf{10}_C$ and the negative-side electromagnetic relay $\mathbf{10}_N$ are turned on to gradually pass a current I via the precharge resistor 76.

Figure 10:
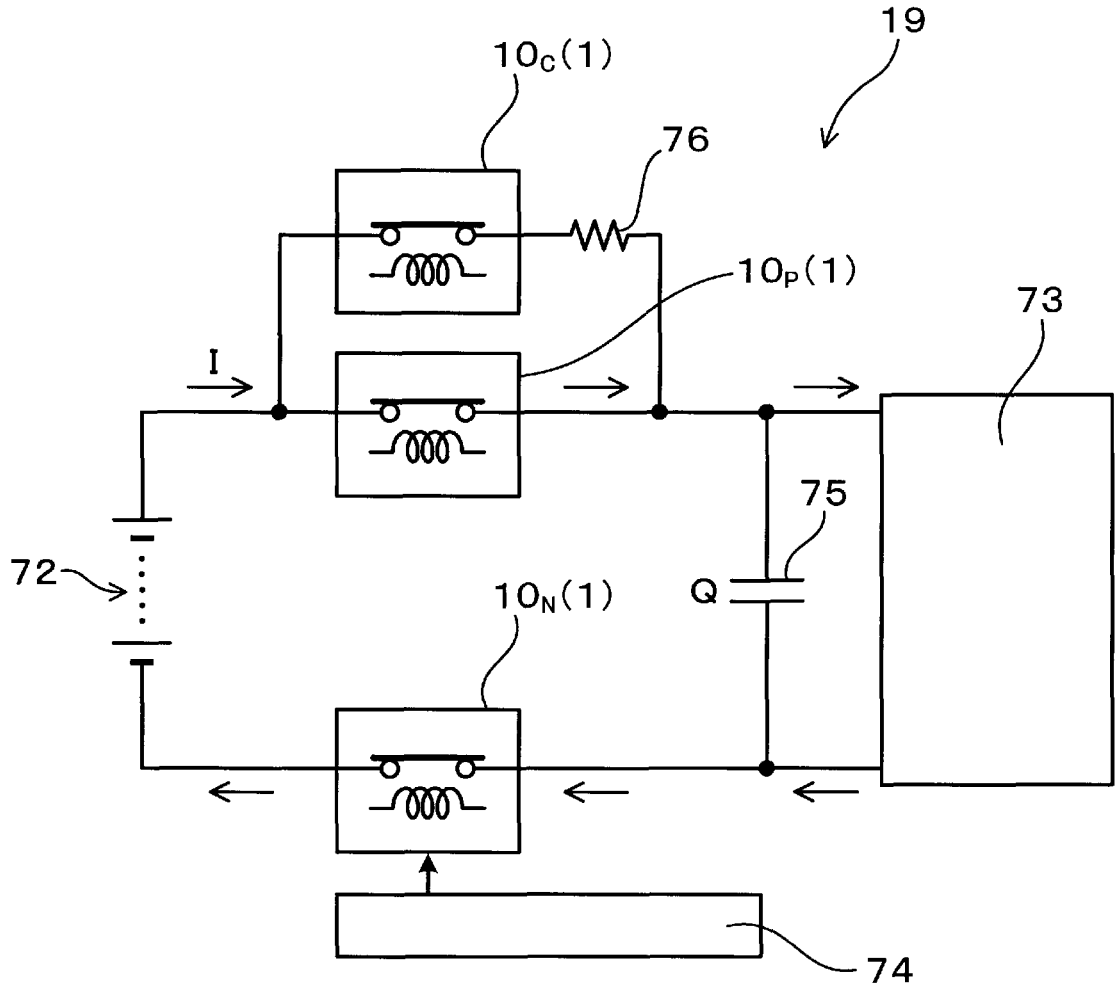
FIG. 10 is a diagram following FIG. 9.
Figure 11:
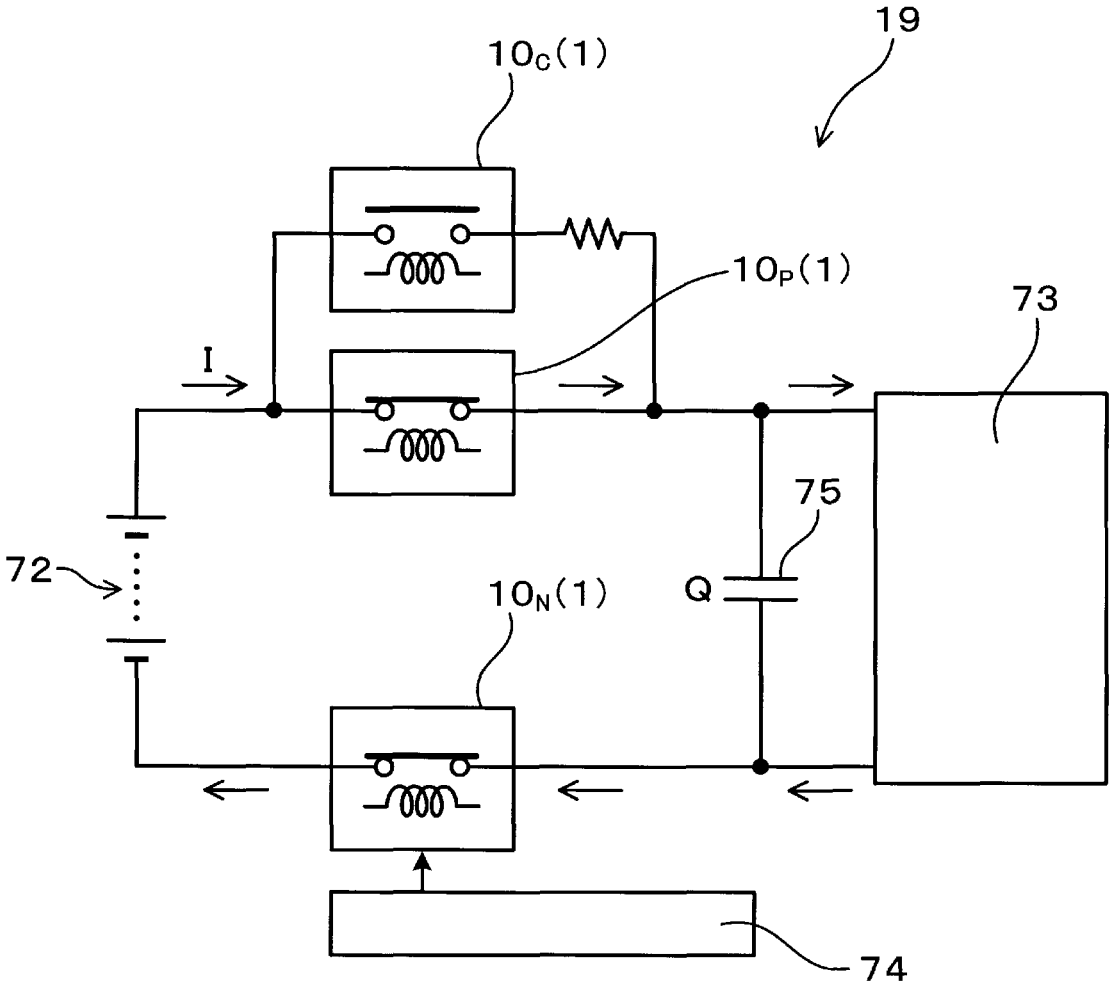
FIG. 11 is a diagram following FIG. 10.

As illustrated in FIG. 10, after the smoothing capacitor 75 is charged to prevent the flow of the inrush current, the positive-side electromagnetic relay $\mathbf{10}_P$ is turned on. Subsequently, as illustrated in FIG. 11, the precharge electromagnetic relay $\mathbf{10}_C$ is turned off. Then, the current I is continuously passed through the electrical equipment 73 via the positive-side electromagnetic relay $\mathbf{10}_P$ and the negative-side electromagnetic relay $\mathbf{10}_N$.

Now, functions and effects of the present embodiment will be described. As illustrated in FIG. 3, in the present embodiment, when the movable core 4 is attracted to the access position, the magnetic spring 5 is prevented from being deformed to the minimum spring length $L_{MIN}$.

Thus, the present embodiment eliminates a need for the use of the area of the magnetic spring 5 (near the minimum spring length $L_{MIN}$: see FIG. 6) where the spring force of the magnetic spring 5 varies significantly among the products. This in turn enables prevention of a failure to suck the movable core 4 resulting from insufficiency of the attraction force of the movable core 4 (that is, the force obtained by subtracting the spring force of the magnetic spring 5 from an electromagnetic force resulting from conduction of current through the electromagnetic coil 2) and also allows suppression of significant variation in attraction speed of the movable core 4.

Additionally, the above-described configuration allows the use of only the area (see FIG. 6) of the magnetic spring 5 where the amount of displacement from the natural length and the spring force are in a substantially proportional relationship. The area involves an insignificant variation among products, thus facilitating design of the magnetic spring 5. In other words, the magnetic spring 5 needs to satisfy both magnetic characteristics and mechanical characteristics (spring force), and thus a significant variation in spring force makes design difficult. However, in the present embodiment, the use of only the area with an insignificant variation in spring force among products is allowed, facilitating design of the magnetic spring 5.

Additionally, as illustrated in FIG. 1, the magnetic spring 5 according to the present embodiment is formed by spirally winding the leaf spring member 50 including a magnetic substance such that the thickness direction of the leaf spring member 50 coincides with the radial direction of the electromagnetic coil 2, and the central portion 51 of the magnetic spring 5 is located biased toward one side in the Z direction compared to the peripheral portion 52 of the magnetic spring 5.

The use of the magnetic spring 5 with the structure as described above facilitates an increase in cross-sectional area of the magnetic spring 5. Thus, a large amount of the magnetic flux $\phi$ can be passed through the magnetic spring 5, allowing for an increase in attraction force of the movable core 4. This also facilitates an increase in contact area between the magnetic spring 5 and the fixed core 3 and an increase in contact area between the magnetic spring 5 and the movable core 4. Thus, the amount of magnetic flux $\phi$ flowing can be increased, and the attraction force of the movable core 4 can be increased. Additionally, the use of the magnetic spring 5 with the above-described structure allows for a gradual increase in contact area between the magnetic spring 5 and the fixed core 3 and in contact area between the magnetic spring 5 and the movable core 4 in keeping with attraction of the movable core 4. Accordingly, even in a case where the movable core 4 approaches the fixed core 3 and increases the spring force of the magnetic spring 5, the amount of magnetic flux $\phi$ flowing increases, thus enabling an increase in electromagnetic force of the electromagnetic coil 2 to allow the movable core 4 to be attracted by a strong force.

As described above, according to the present embodiment, a solenoid device can be provided that can reduce a manufacturing variation in attraction force of the movable core.

Note that, in the present embodiment, the solenoid device 1 is used in the electromagnetic relay 10 but that the present disclosure intends no such limitation and that the solenoid device 1 can be used in an electromagnetic valve or the like.

In the following embodiments, those of the reference numerals used in the drawings which are the same as the reference numerals used in the first embodiment represent components and the like similar to the corresponding components and the like in the first embodiment unless otherwise specified.

Second Embodiment

Figure 12:
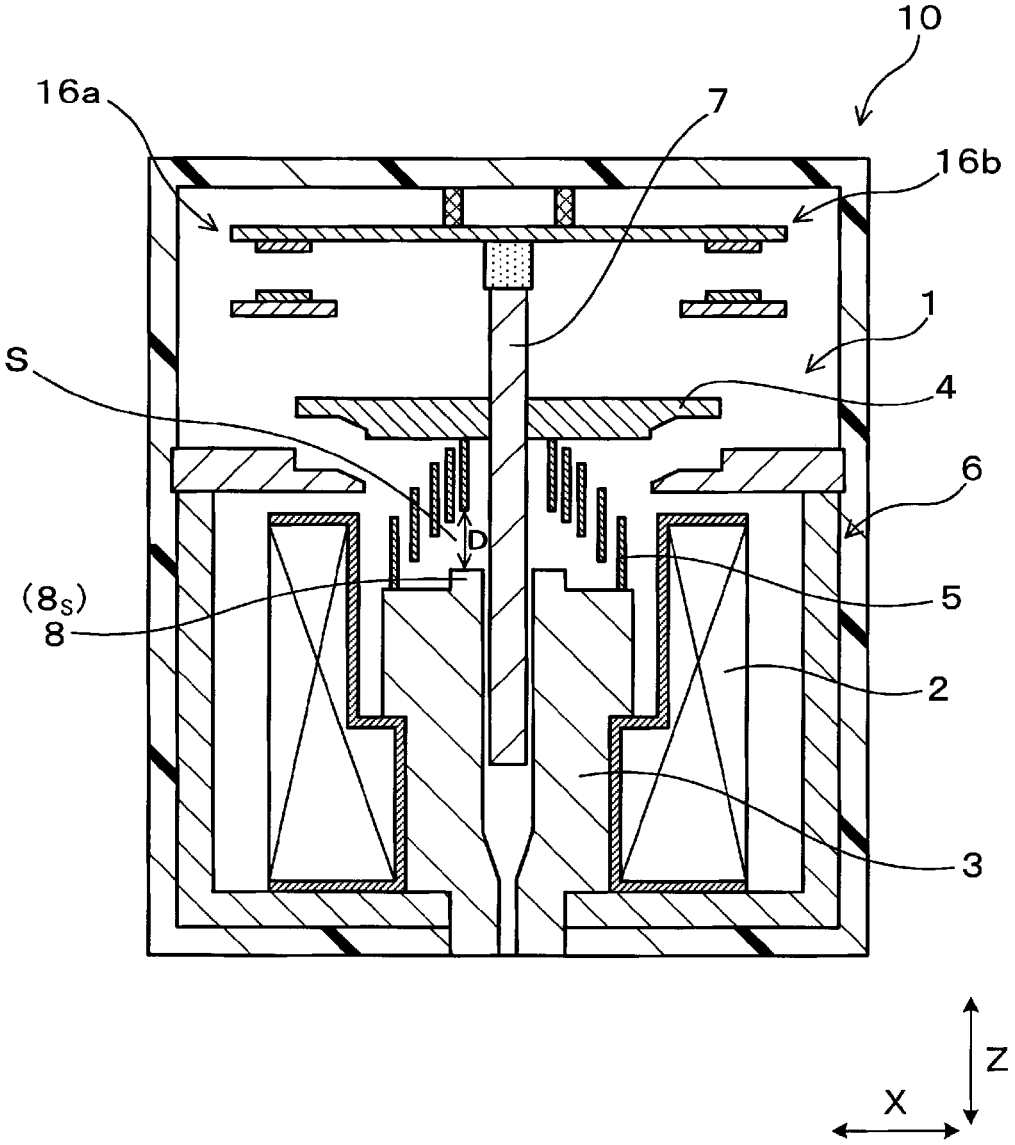
FIG. 12 is a cross-sectional view of a solenoid device in a state in which no current is passed an electromagnetic coil according to a second embodiment.
Figure 13:
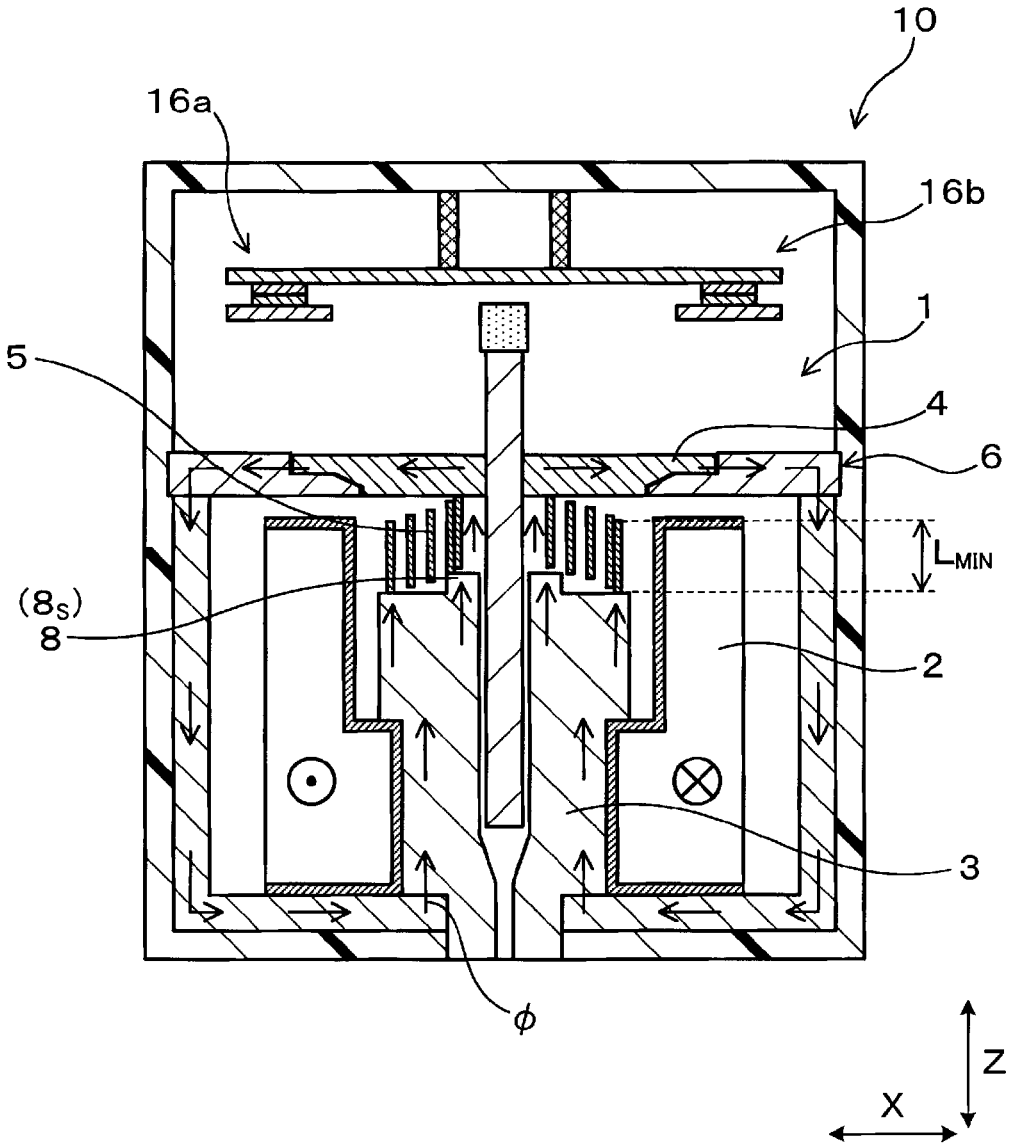
FIG. 13 is a cross-sectional view of the solenoid device in a state in which current is passed the electromagnetic coil according to the second embodiment.

The present embodiment is an example in which the shape of the fixed core 3 is changed. As illustrated in FIG. 12 and FIG. 13, in the present embodiment, a fixed core side protruding portion 8*s* is formed on the fixed core 3. The fixed core side protruding portion 8*s* suppresses deformation of the magnetic spring 5 to the minimum spring length $L_{MIN}$ when the movable core 4 is attracted to the access position (see FIG. 13).

In this way, deformation of the magnetic spring 5 to the minimum spring length $L_{MIN}$ can be more reliably suppressed. Specifically, when the magnetic spring 5 contracts to some degree, the magnetic flux $\phi$ flows through the magnetic spring 5 in the Z direction. Thus, the magnetic flux $\phi$ generates, in the magnetic spring 5 itself, an electromagnetic force causing contraction in the Z direction. However, the fixed core side protruding portion 8*s* formed as in the present embodiment allows suppression of contraction of the magnetic spring 5 to the minimum spring length $L_{MIN}$. This eliminates the need for the use of the area of the magnetic spring 5 near the minimum spring length $L_{MIN}$, that is, the area with significant variation in spring force among products. Accordingly, variation in attraction force of the movable core 4 can be suppressed.

Additionally, as illustrated in FIG. 12, formation of the fixed core side protruding portion 8*s* enables a reduction in Z-direction length D of a space S between the fixed core 3 and the magnetic spring 5 while the movable core 4 is placed at the separation position. As described above, the conduction of current through the electromagnetic coil 2 causes a portion of the magnetic flux ϕ to flow through the space S. The present embodiment enables a reduction in Z-direction length D of the space S, facilitating the flow of the magnetic flux ϕ. Accordingly, the attraction force of the movable core 4 can be increased.

The second embodiment otherwise has a configuration and functions and effects similar to the configuration and functions and effects of the first embodiment.

Third Embodiment

Figure 14:
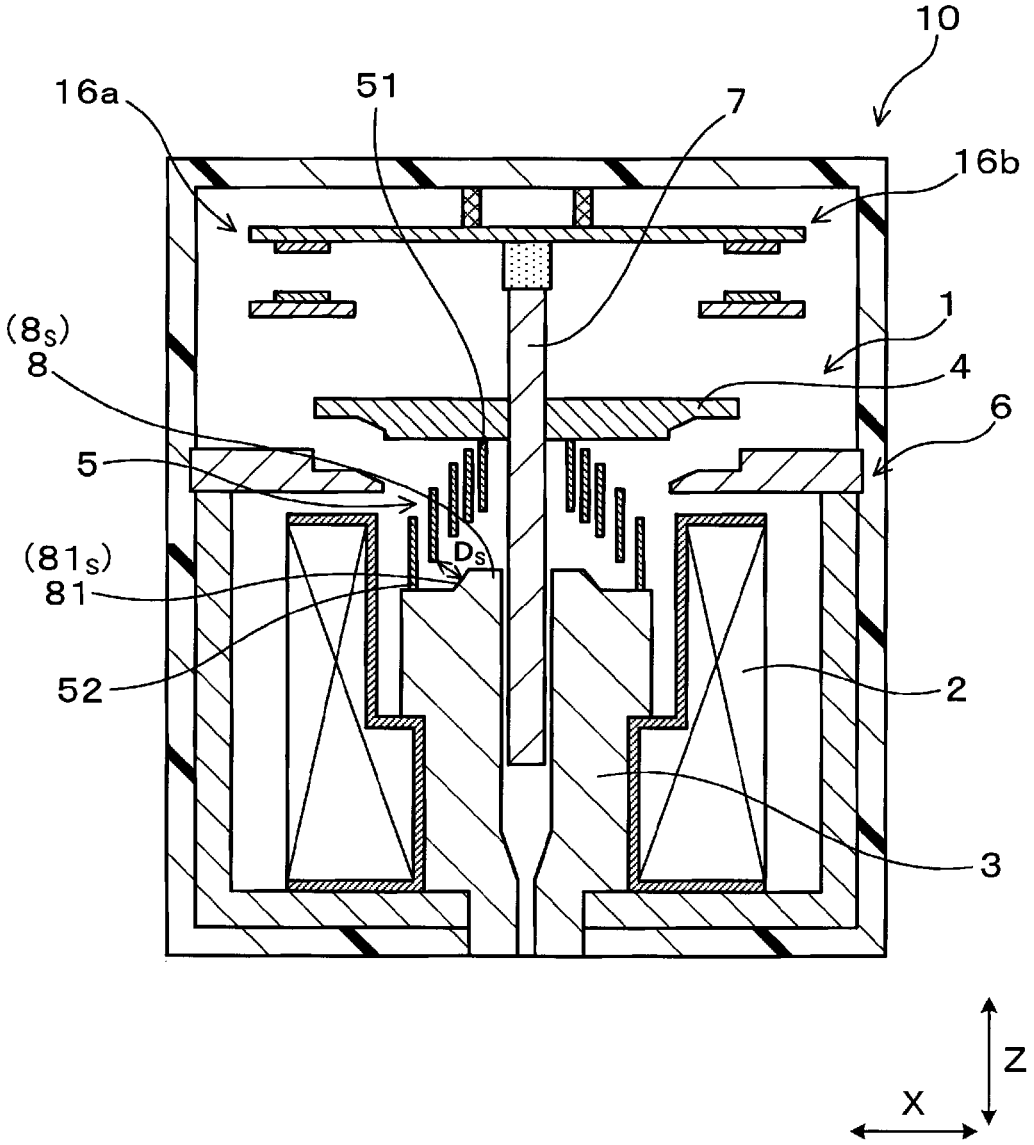
FIG. 14 is a cross-sectional view of a solenoid device in a state in which no current is passed an electromagnetic coil according to a third embodiment.
Figure 15:
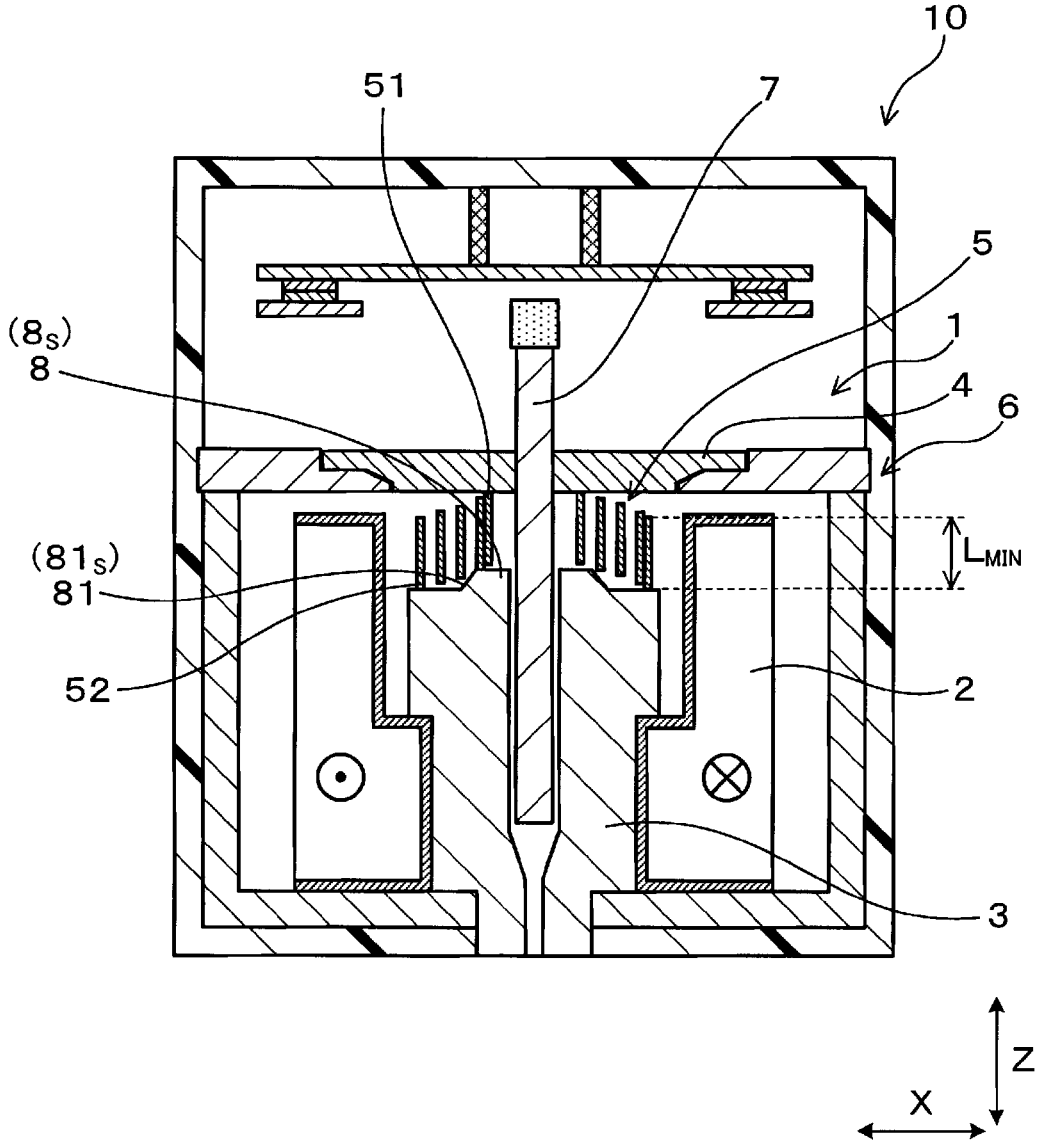
FIG. 15 is a cross-sectional view of the solenoid device in a state in which current is passed the electromagnetic coil according to the third embodiment.

The present embodiment is an example in which the fixed core 3 is deformed. As illustrated in FIG. 14 and FIG. 15, in the present embodiment, the fixed core 3 is provided with the fixed core side protruding portion $\mathbf{8}_S$, as in the second embodiment. In the present embodiment, the fixed core side protruding portion $\mathbf{8}_S$ is provided with a tapered surface 81 (fixed core side tapered surface $\mathbf{81}_S$). The fixed core side tapered surface $\mathbf{81}_S$ is configured to overlap a part of the magnetic spring 5 when viewed from the Z direction.

Functions and effects of the present embodiment will be described. In the present embodiment, the fixed core 3 is provided with the fixed core side protruding portion $\mathbf{8}_S$. Thus, as is the case with the second embodiment, when the movable core 4 is attracted to the access position (see FIG. 15), deformation of the magnetic spring 5 to the minimum spring length $L_{MIN}$ can be more reliably suppressed. Additionally, the fixed core side protruding portion $\mathbf{8}_S$ is provided with the tapered surface 81 (fixed core side tapered surface $\mathbf{81}_S$). This configuration enables a reduction in distance $D_S$ between the fixed core side protruding portion $\mathbf{8}_S$ and the magnetic spring 5 in an oblique direction as illustrated in FIG. 14. This in turn facilitates the flow, between the fixed core side protruding portion $\mathbf{8}_S$ and the magnetic spring 5, of the magnetic flux ϕ resulting from the conduction of current through the electromagnetic coil 2, allowing the attraction force of the movable core 4 to be increased.

The third embodiment otherwise has a configuration and functions and effects similar to the configuration and functions and effects of the first embodiment.

Fourth Embodiment

Figure 16:
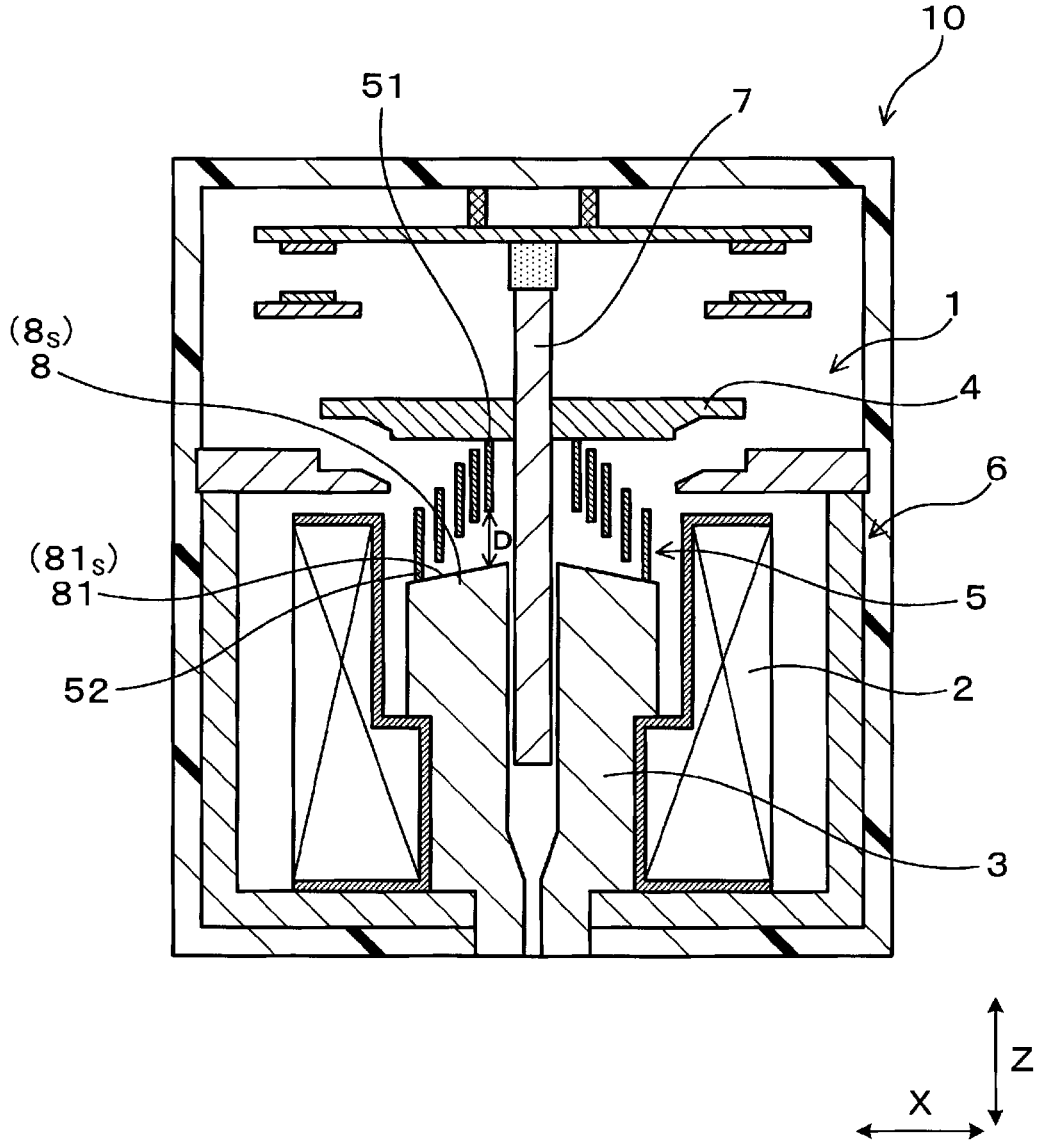
FIG. 16 is a cross-sectional view of a solenoid device in a state in which no current is passed an electromagnetic coil according to a fourth embodiment.
Figure 17:
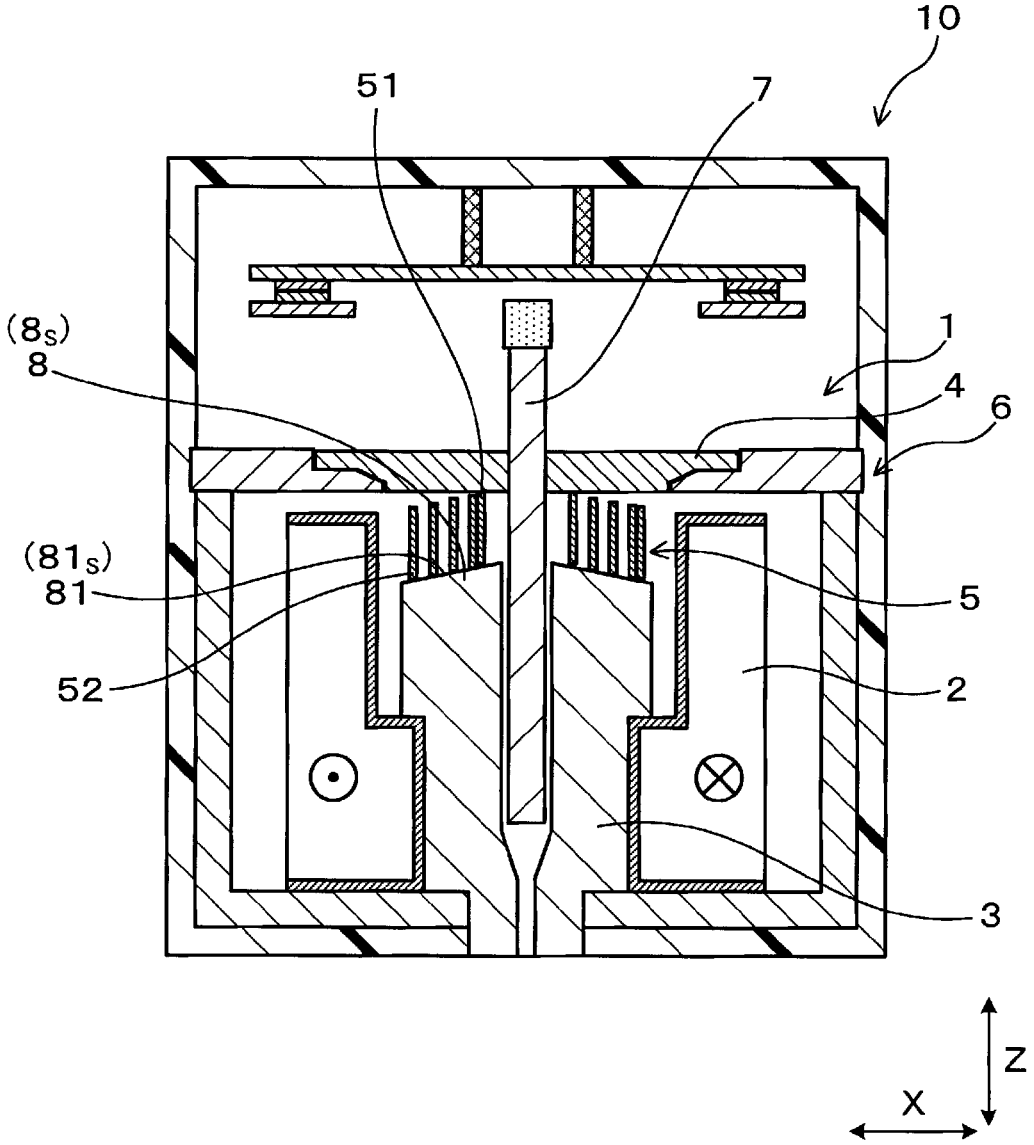
FIG. 17 is a cross-sectional view of the solenoid device in a state in which current is passed the electromagnetic coil according to the fourth embodiment.

The present embodiment is an example in which the shape of the fixed core 3 is changed. As illustrated in FIG. 16 and FIG. 17, in the present embodiment, the fixed core 3 is provided with the fixed core side protruding portion $\mathbf{8}_S$ as is the case with the third embodiment. The fixed core side protruding portion $\mathbf{8}_S$ is provided with the tapered surface 81 (fixed core side tapered surface $\mathbf{81}_S$). In the present embodiment, all the portions of the magnetic spring 5 are configured to overlap the fixed core side tapered surface $\mathbf{81}_S$ when viewed from the Z direction.

Functions and effects of the present embodiment will be described. The solenoid device 1 according to the present embodiment is configured such that all the portions of the magnetic spring 5 overlap the fixed core side tapered surface $\mathbf{81}_S$ when viewed from the Z direction. Thus, all the portions of the magnetic spring 5 can be located closer to the fixed core side tapered surface $\mathbf{81}_S$. Accordingly, the magnetic flux ϕ flows easily between the fixed core side tapered surface $\mathbf{81}_S$ and the magnetic spring 5, allowing the attraction force of the movable core 4 to be increased.

The fourth embodiment otherwise has a configuration and functions and effects similar to the configuration and functions and effects of the first embodiment.

Fifth Embodiment

Figure 18:
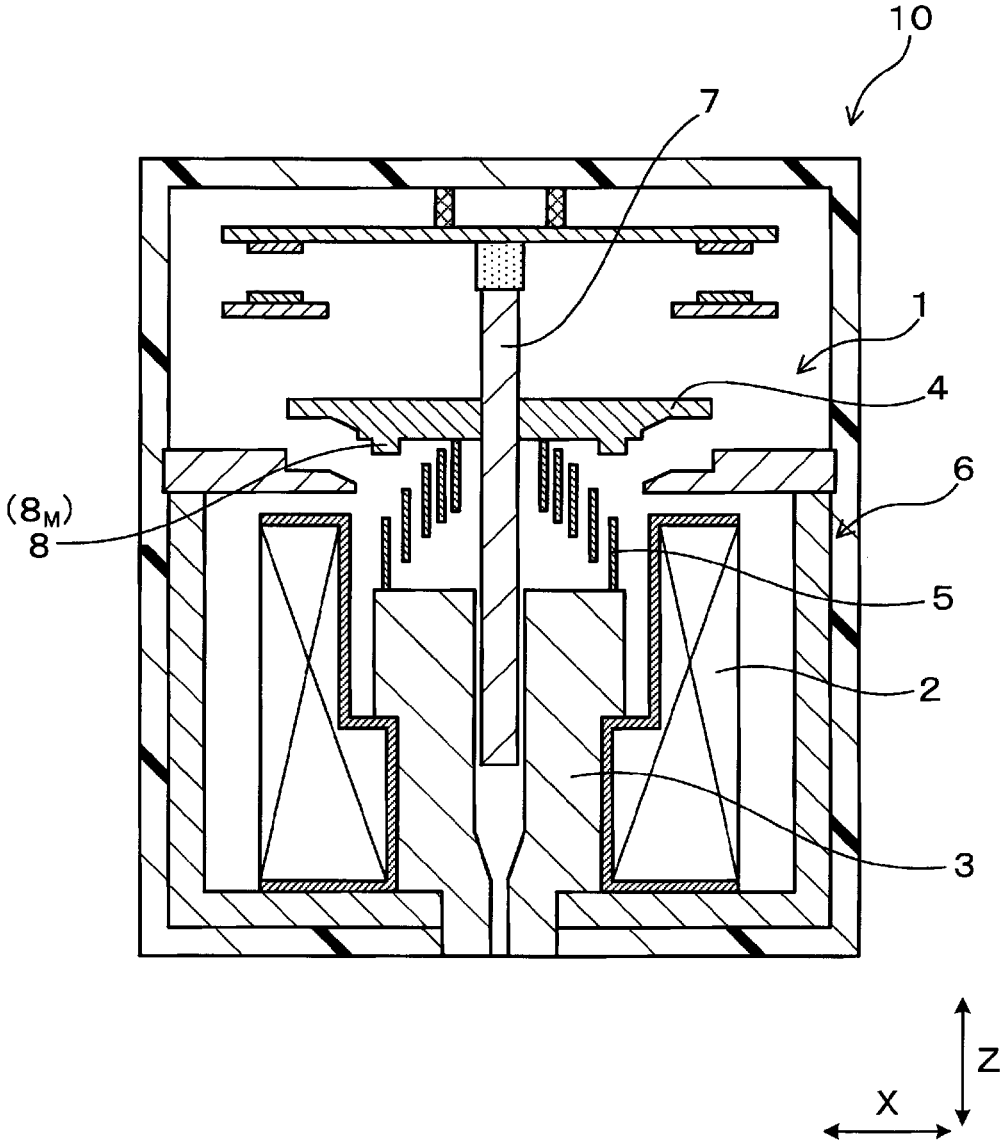
FIG. 18 is a cross-sectional view of a solenoid device in a state in which no current is passed an electromagnetic coil according to a fifth embodiment.
Figure 19:
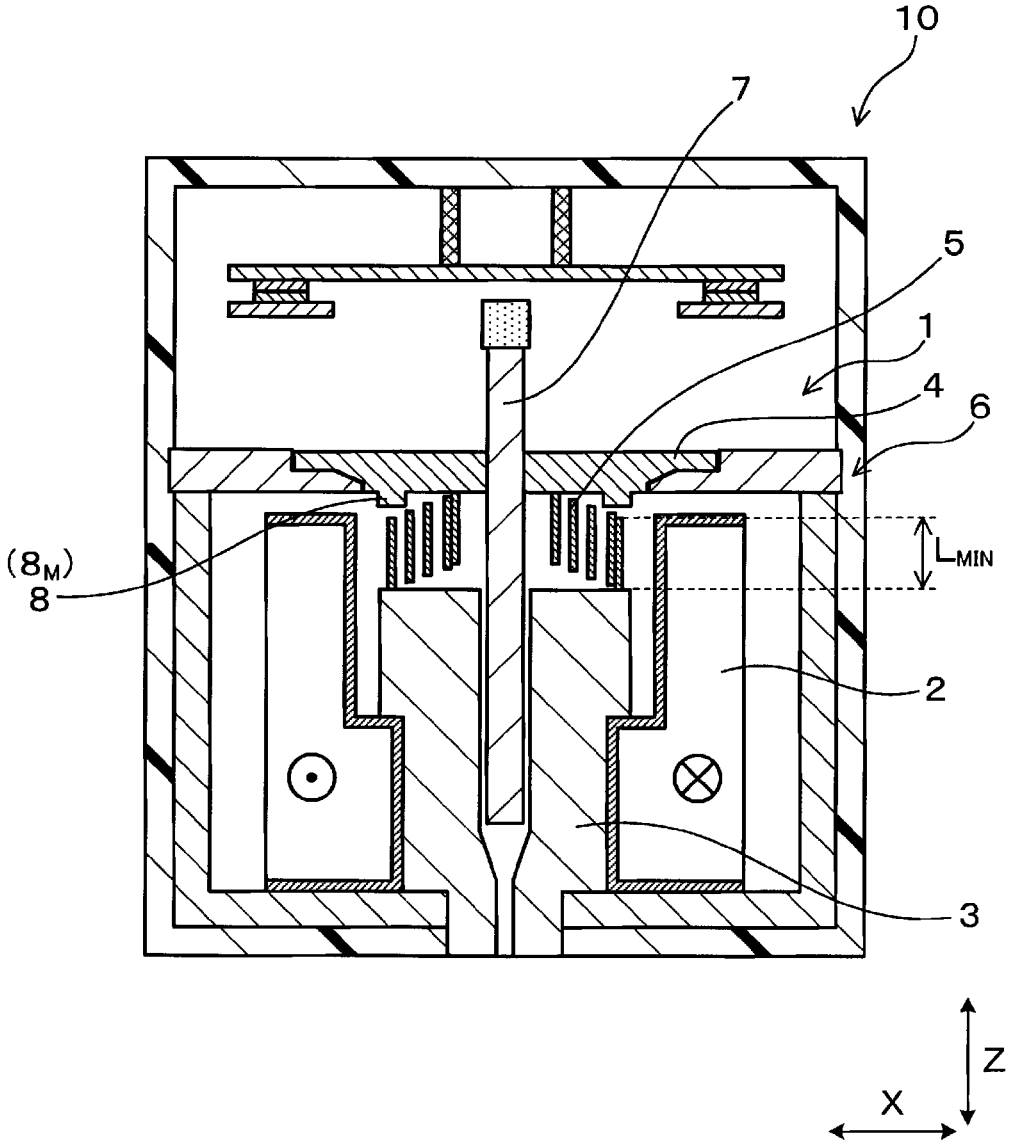
FIG. 19 is a cross-sectional view of the solenoid device in a state in which current is passed the electromagnetic coil according to the fifth embodiment.

The present embodiment is an example in which the shape of the movable core 4 is changed. As illustrated in FIG. 18 and FIG. 19, in the present embodiment, the movable core 4 is provided with a movable core side protruding portion $\mathbf{8}_M$. As illustrated in FIG. 19, the movable core side protruding portion $\mathbf{8}_M$ suppresses deformation of the magnetic spring 5 to the minimum spring length $L_{MIN}$ when the movable core 4 is attracted to the access position.

Functions and effects of the present embodiment will be described. The above-described configuration allows more reliable suppression of deformation of the magnetic spring 5 to the minimum spring length $L_{MIN}$ when the movable core 4 is attracted to the access position.

The fifth embodiment otherwise has a configuration and functions and effects similar to the configuration and functions and effects of the first embodiment.

Sixth Embodiment

Figure 20:
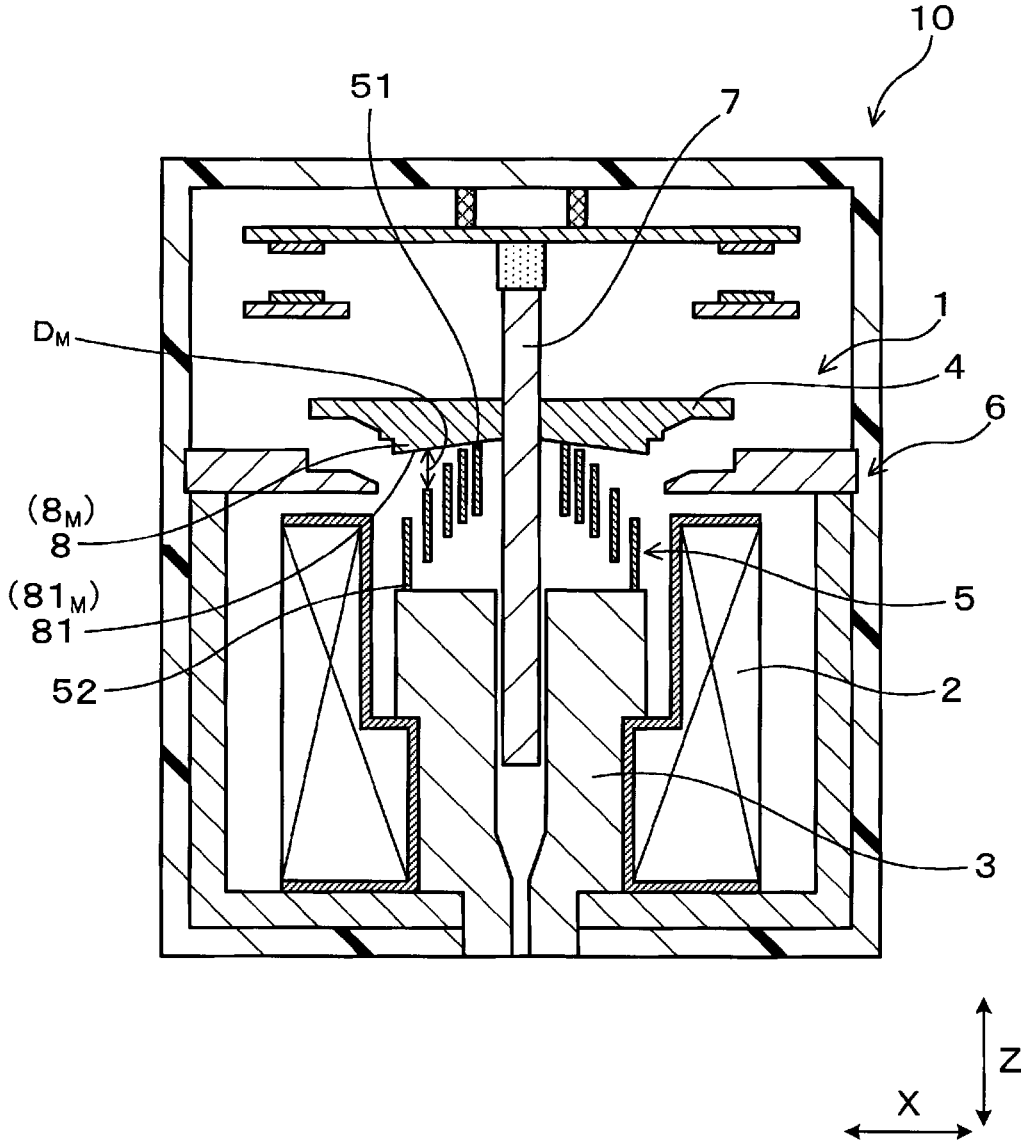
FIG. 20 is a cross-sectional view of a solenoid device in a state in which no current is passed an electromagnetic coil according to a sixth embodiment.
Figure 21:
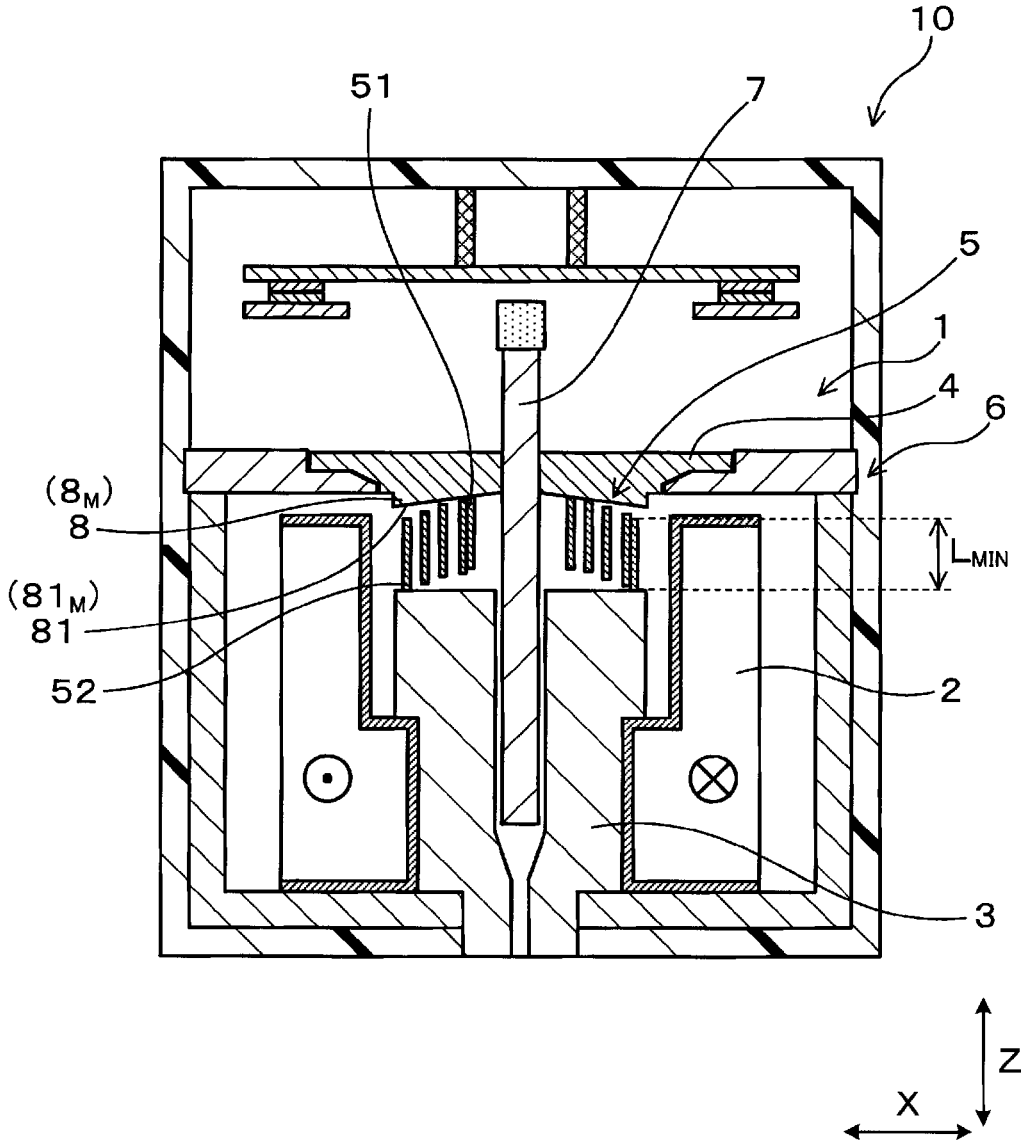
FIG. 21 is a cross-sectional view of the solenoid device in a state in which current is passed an electromagnetic coil according to the sixth embodiment.

The present embodiment is an example in which the shape of the movable core 4 is changed. As illustrated in FIG. 20 and FIG. 21, in the present embodiment, the movable core 4 is provided with the movable core side protruding portion $\mathbf{8}_M$ as is the case with the fifth embodiment. Additionally, in the present embodiment, the movable core side protruding portion $\mathbf{8}_M$ is provided with the tapered surface 81 (movable core side tapered surface $\mathbf{81}_M$). The movable core side tapered surface $\mathbf{81}_M$ is configured to overlap all the portions of the magnetic spring 5 when viewed from the Z direction.

Functions and effects of the present embodiment will be described. Formation of the movable core side tapered surface $\mathbf{81}_M$ enables a reduction in a distance $D_M$ between the magnetic spring 5 and the movable core 4 while the movable core 4 is not attracted, as illustrated in FIG. 20. This facilitates the flow of the magnetic flux ϕ between the magnetic spring 5 and the movable core 4, allowing the attraction force of the movable core 4 to be increased.

Additionally, the present embodiment is configured such that all the portions of the magnetic spring 5 overlap the movable core side tapered surface $\mathbf{81}_M$ when viewed from the Z direction.

Thus, as illustrated in FIG. 20, all the portions of the magnetic spring 5 can be located closer to the movable core side tapered surface $\mathbf{81}_M$. Accordingly, the magnetic flux ϕ flows easily between the movable core side tapered surface $\mathbf{81}_M$ and the magnetic spring 5, allowing the attraction force of the movable core 4 to be increased.

The sixth embodiment otherwise has a configuration and functions and effects similar to the configuration and functions and effects of the first embodiment.

Note that the present embodiment is configured such that the movable core side tapered surface $\mathbf{81}_M$ overlaps all the portions of the magnetic spring 5 when viewed from the Z direction but that the present invention intends no such limitation. Specifically, the movable core side tapered surface $\mathbf{81}_M$ may overlap a part of the magnetic spring 5 when viewed from the Z direction.

Seventh Embodiment

Figure 22:
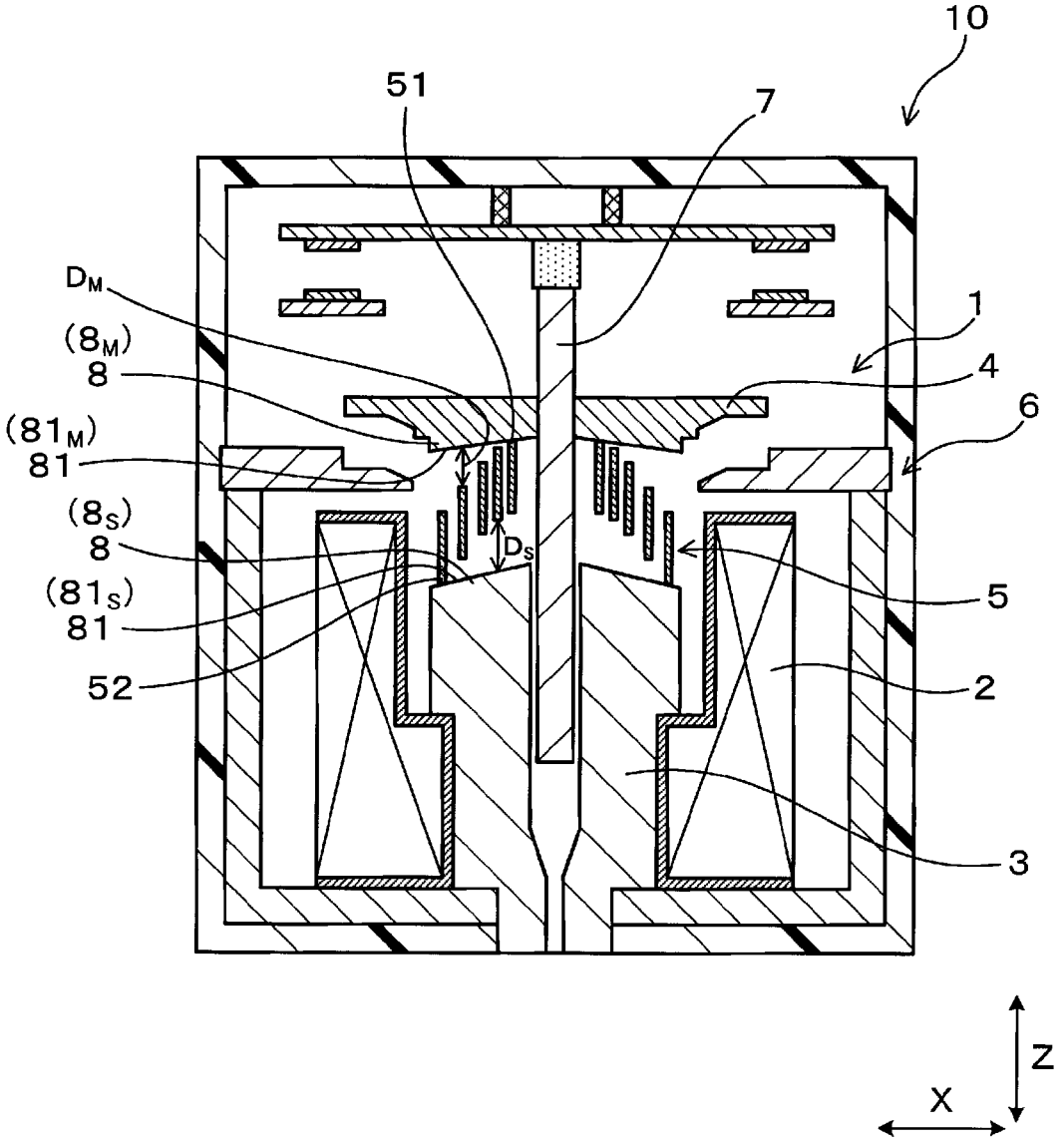
FIG. 22 is a cross-sectional view of a solenoid device in a state in which no current is passed an electromagnetic coil according to a seventh embodiment.

The present embodiment is an example in which the shapes of the fixed core 3 and the movable core 4 are changed. As illustrated in FIG. 22, in the present embodiment, the protruding portion 8 is formed on both the fixed core 3 and the movable core 4.

Figure 23:
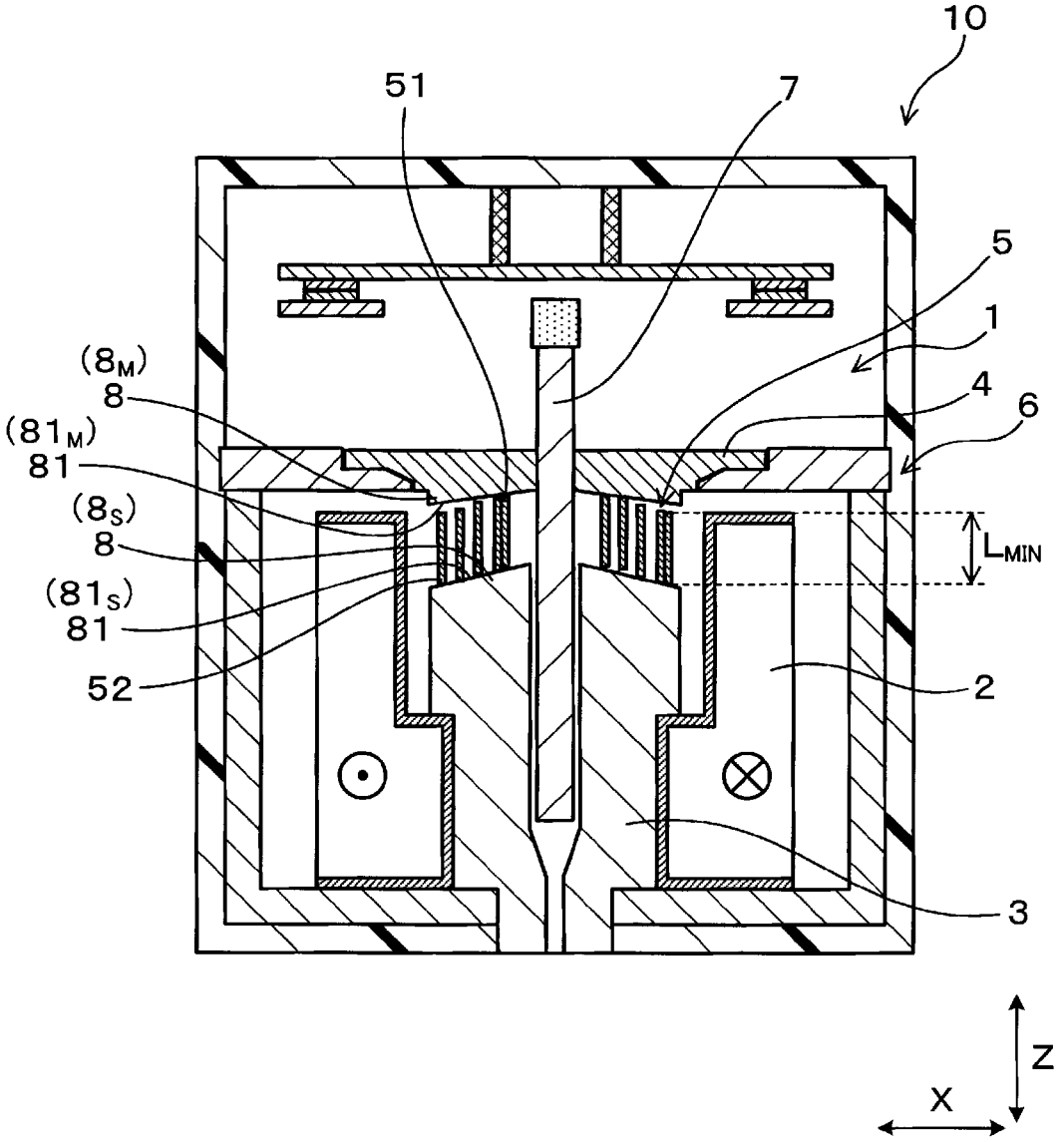
FIG. 23 is a cross-sectional view of the solenoid device in a state in which current is passed an electromagnetic coil according to the seventh embodiment.

As illustrated in FIG. 23, the protruding portion 8 (fixed core side protruding portion $\mathbf{8}_S$) formed on the fixed core 3 and the protruding portion 8 (movable core side protruding portion $\mathbf{8}_M$) formed on the movable core 4 suppress deformation of the magnetic spring 5 to the minimum spring length $L_{MIN}$ when the movable core 4 is attracted.

The fixed core side protruding portion $\mathbf{8}_S$ is provided with the tapered surface 81 (fixed core side tapered surface $\mathbf{81}_S$). Additionally, the movable core side protruding portion $\mathbf{8}_M$ is also provided with the tapered surface 81 (movable core side tapered surface $\mathbf{81}_M$). The tapered surfaces 81 are configured to overlap all the portions of the magnetic spring 5 when viewed from the Z direction.

Functions and effects of the present embodiment will be described. In the present embodiment, both the fixed core 3 and the movable core 4 are provided with the protruding portion 8 ($\mathbf{8}_S$ and $\mathbf{8}_M$).

This enables a reduction in the distance $D_S$ between the fixed core 3 and the magnetic spring 5 and also in the distance $D_M$ between the movable core 4 and the magnetic spring 5. Accordingly, the flow of the magnetic flux $\phi$ is facilitated, allowing the attraction force of the movable core 4 to be increased.

Additionally, the solenoid device 1 according to the present embodiment is configured such that all the portions of the magnetic spring 5 overlap the fixed core side tapered surface $\mathbf{81}_S$ and the movable core side tapered surface $\mathbf{81}_M$ when viewed from the Z direction.

Thus, all the portions of the magnetic spring 5 can be located closer to the fixed core side tapered surface $\mathbf{81}_S$ and also closer to the movable core side tapered surface $\mathbf{81}_M$. Accordingly, the magnetic flux $\phi$ flows easily between the fixed core side tapered surface $\mathbf{81}_S$ and the magnetic spring 5 and between the magnetic spring 5 and the movable core side tapered surface $\mathbf{81}_M$, allowing the attraction force of the movable core 4 to be increased.

The seventh embodiment otherwise has a configuration and functions and effects similar to the configuration and functions and effects of the first embodiment.

Eighth Embodiment

Figure 24:
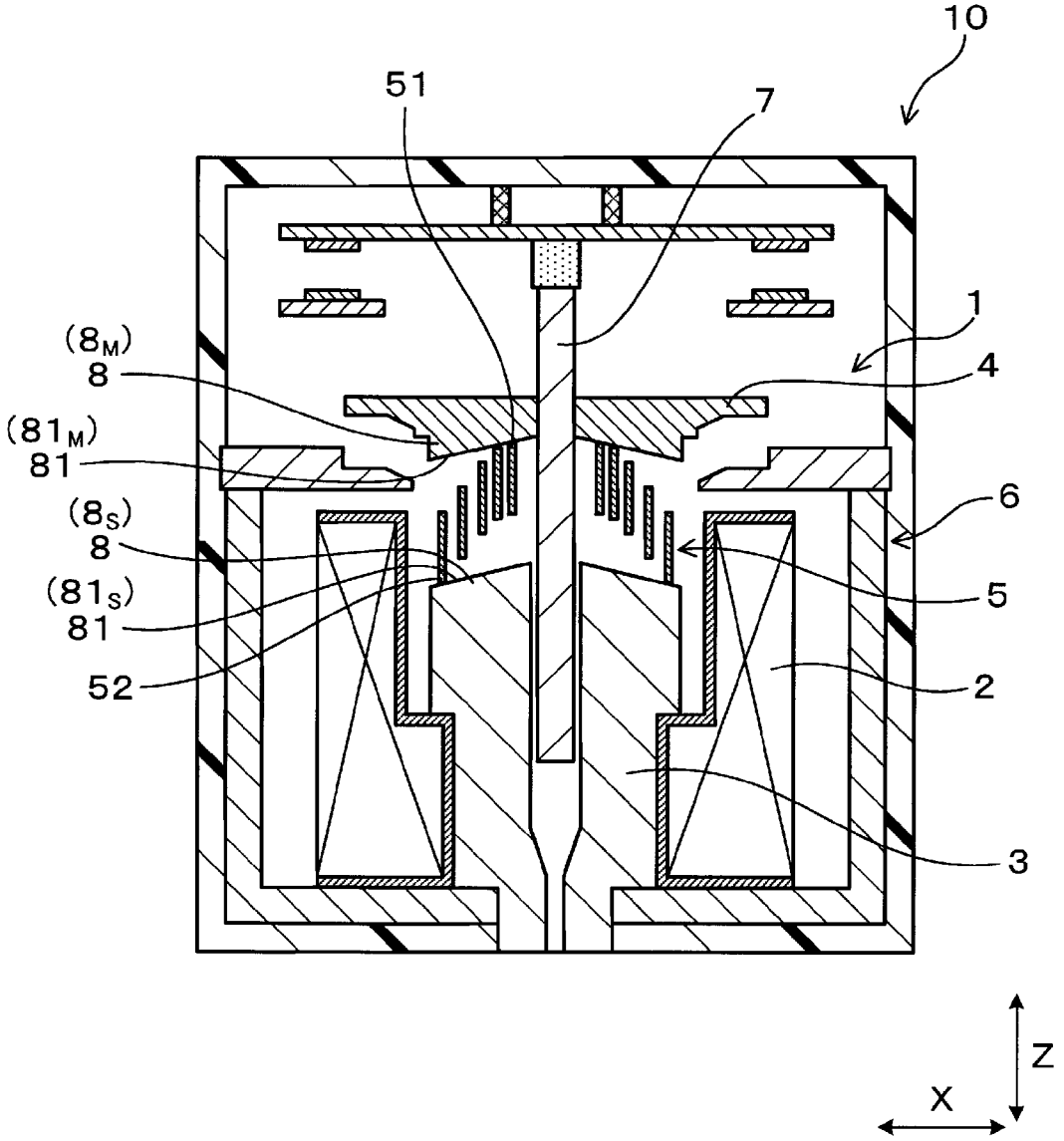
FIG. 24 is a cross-sectional view of a solenoid device in a state in which no current is passed an electromagnetic coil according to an eighth embodiment.
Figure 25:
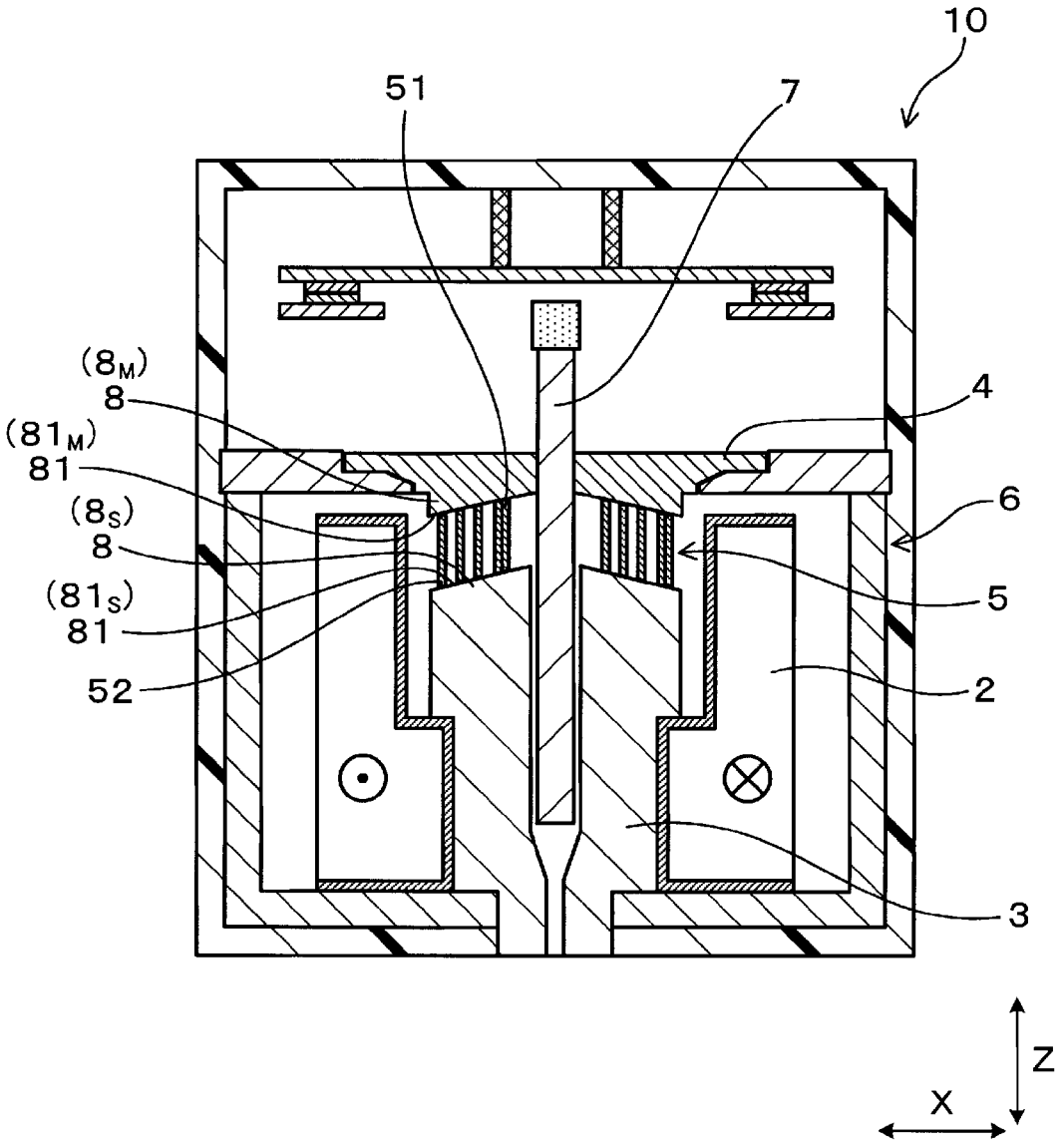
FIG. 25 is a cross-sectional view of the solenoid device in a state in which current is passed an electromagnetic coil according to the eighth embodiment.

The present embodiment is an example in which the shapes of the fixed core 3 and the movable core 4 are changed. As illustrated in FIG. 24 and FIG. 25, in the present embodiment, the fixed core 3 and the movable core 4 are provided with the respective protruding portions 8 (the fixed core side protruding portion $\mathbf{8}_S$ and the movable core side protruding portion $\mathbf{8}_M$) as is the case with the seventh embodiment. Additionally, the individual protruding portions 8 ($\mathbf{8}_S$ and $\mathbf{8}_M$) are provided with the tapered surfaces 81 (the fixed core side tapered surface $\mathbf{81}_S$ and the movable core side tapered surface $\mathbf{81}_M$). The two tapered surfaces $\mathbf{81}_S$ and $\mathbf{81}_M$ are parallel to each other.

Functions and effects of the present embodiment will be described. In the present embodiment, the two tapered surfaces $\mathbf{81}_S$ and $\mathbf{81}_M$, that is, the fixed core side tapered surface $\mathbf{81}_S$ and the movable core side tapered surface $\mathbf{81}_M$, are parallel to each other.

This allows minimization of a possible gap between the fixed core side tapered surface $\mathbf{81}_S$ and the magnetic spring 5 and a possible gap between the movable core side tapered surface $\mathbf{81}_M$ and the magnetic spring 5 when the movable core 4 is attracted, as illustrated in FIG. 25. Accordingly, the movable core 4 can be continuously attracted by a stronger attraction force.

The eighth embodiment otherwise has a configuration and functions and effects similar to the configuration and functions and effects of the first embodiment.

Ninth Embodiment

Figure 26:
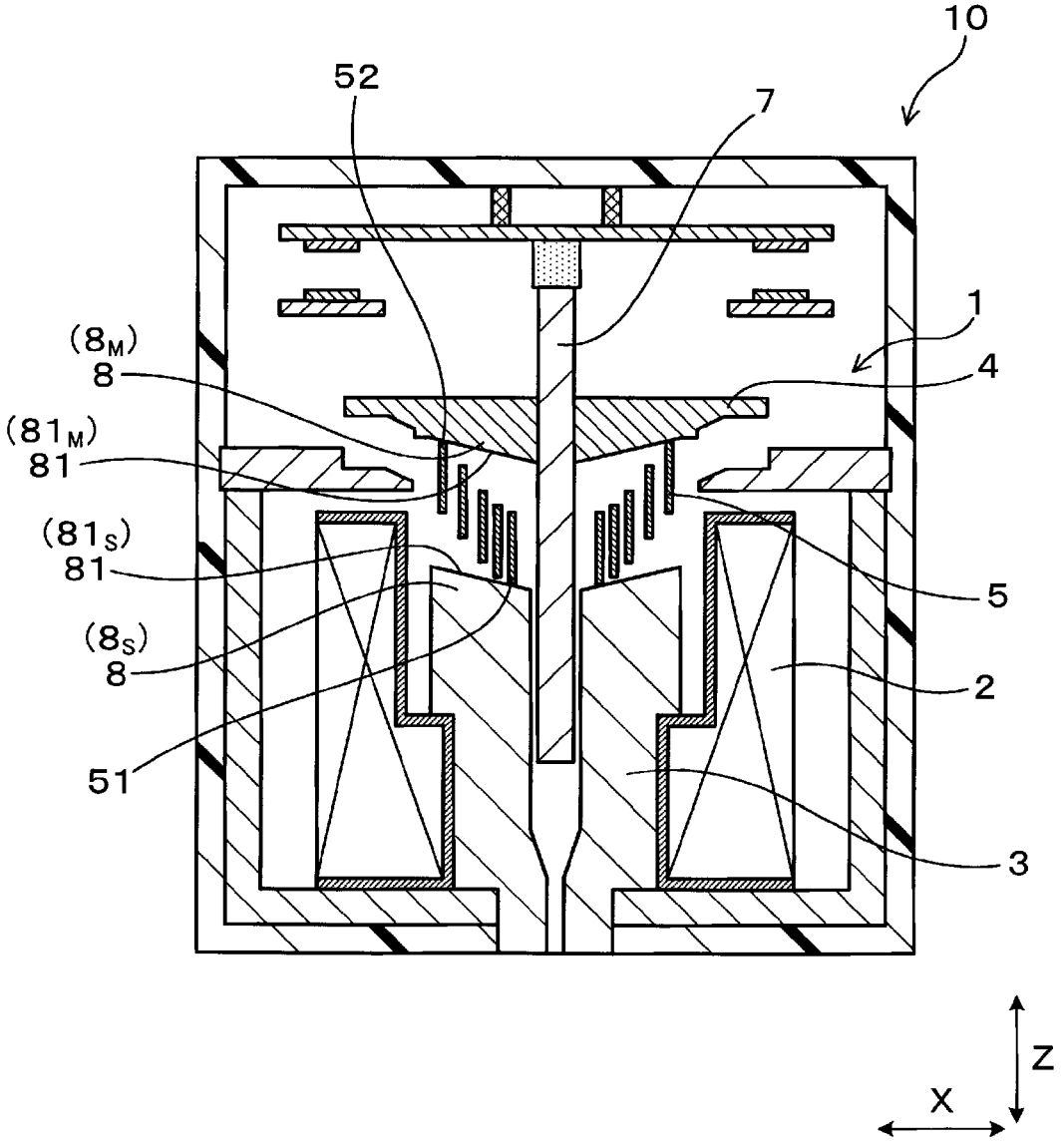
FIG. 26 is a cross-sectional view of a solenoid device in a state in which no current is passed an electromagnetic coil according to a ninth embodiment.
Figure 27:
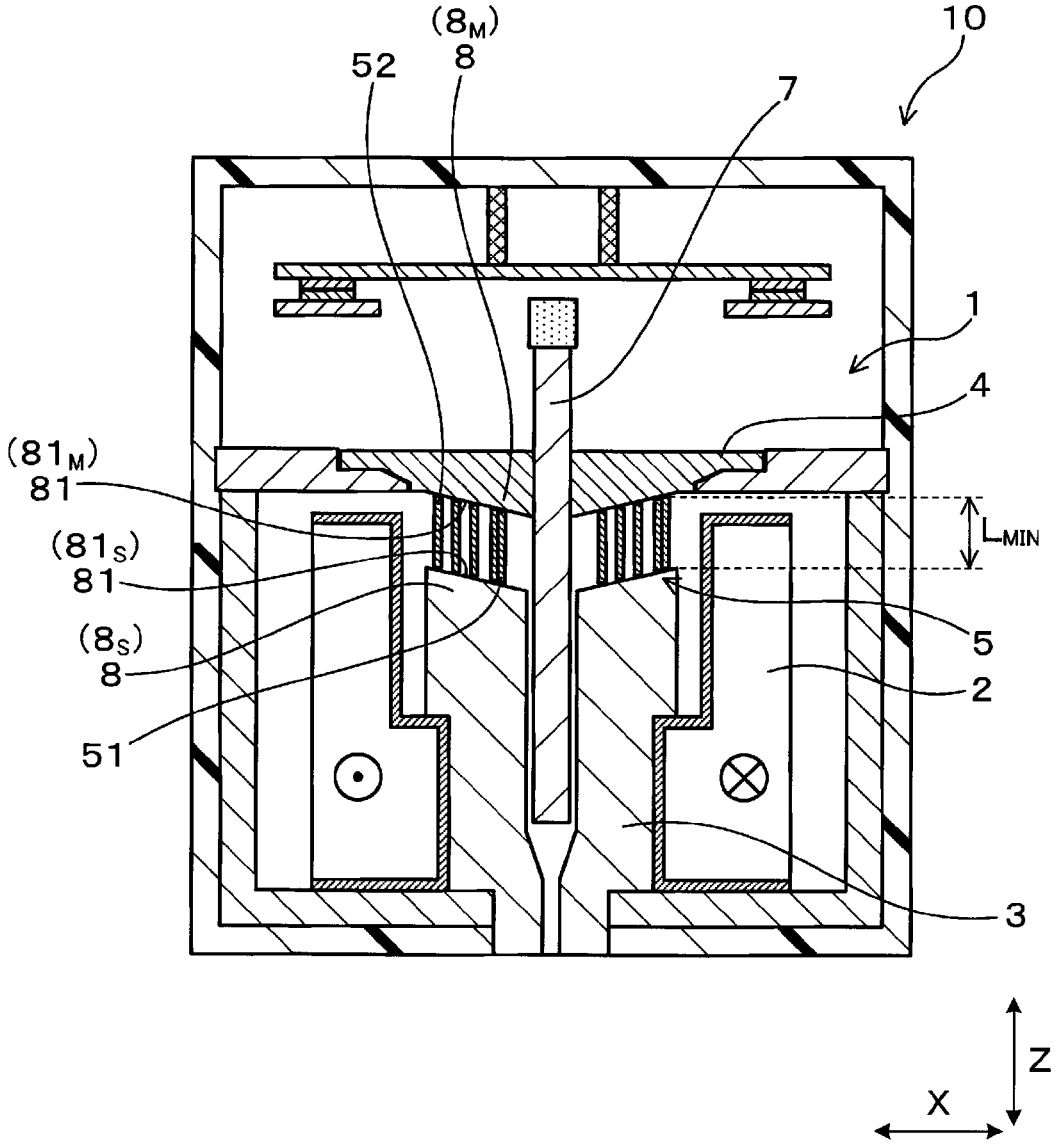
FIG. 27 is a cross-sectional view of the solenoid device in a state in which current is passed an electromagnetic coil according to the ninth embodiment.

In the present embodiment, the shapes the fixed core 3 and the movable core 4 and the direction of the magnetic spring 5 are changed. As illustrated in FIG. 26 and FIG. 27, in the present embodiment, the central portion 51 of the magnetic spring 5 is directed toward the fixed core 3, and the peripheral portion 52 of the magnetic spring 5 is directed toward the movable core 4. Additionally, the fixed core 3 and the movable core 4 are each provided with the protruding portion 8. The protruding portions 8 ($\mathbf{8}_S$ and $\mathbf{8}_M$) prevent the magnetic spring 5 from being deformed to the minimum spring length $L_{MIN}$ when the movable core 4 is attracted.

Additionally, the fixed core side protruding portion $\mathbf{8}_S$ is provided with the fixed core side tapered surface $\mathbf{81}_S$, and the movable core side protruding portion $\mathbf{8}_M$ is provided with the movable core side tapered surface $\mathbf{81}_M$. The tapered surfaces $\mathbf{81}_S$ and $\mathbf{81}_M$ are configured to overlap all the portions of the magnetic spring 5 when viewed from the Z direction.

The ninth embodiment otherwise has a configuration and functions and effects similar to the configuration and functions and effects of the first embodiment.

The present disclosure has been described in compliance with the embodiments. However, it is understood that the present disclosure is not intended to be limited to the embodiments or structures. The present disclosure includes various modified examples and modifications within the range of equivalency. In addition, the scope of the present disclosure and the range of concepts of the present disclosure include various combinations or configurations and further include other combinations and configurations corresponding to addition of only one element, two or more elements, or a portion of one element to the above-described various combinations or configurations.

What is claimed is:

1. A solenoid device comprising:

an electromagnetic coil through which current is passed to generate a magnetic flux;

a fixed core disposed in the electromagnetic coil;

a movable core performing reciprocation in an axial direction of the electromagnetic coil depending on whether current is passed the electromagnetic coil;

a magnetic spring disposed between the fixed core and the movable core and including a magnetic substance, the magnetic spring biasing the movable core in a direction away from the fixed core in the axial direction; and a yoke included in a magnetic circuit in which the magnet flux flows, the magnetic circuit also including the magnetic spring, the movable core, and the fixed core, wherein when current is passed the electromagnetic coil, the movable core is attracted to an access position by an electromagnetic force against a spring force of the magnetic spring, the access position being relatively close to the fixed core, the electromagnetic force resulting from the conduction of current, and when the conduction of current through the electromagnetic coil is stopped, the movable core is moved to a separation position by the spring force of the magnetic spring, the separation position being farther from the fixed core than the access position, the magnetic spring includes a leaf spring member comprising the magnetic substance and spirally wound such that a thickness direction of the leaf spring member coincides with a radial direction of the electromagnetic coil, a central portion of the magnetic spring is located on one side in the axial direction with respect to a peripheral portion of the magnetic spring, and when the movable core is attracted to the access position, the magnetic spring is prevented from being deformed to a minimum spring length corresponding to a width of the leaf spring member in the axial direction.

2. The solenoid device according to claim 1, wherein the fixed core is provided with a fixed core side protruding portion protruding from the fixed core toward the movable core in the axial direction and suppressing deformation of the magnetic spring to the minimum spring length when the movable core is attracted to the access position.

3. The solenoid device according to claim 2, wherein the fixed core side protruding portion is provided with a fixed core side tapered surface overlapping at least a part of the magnetic spring as viewed in the axial direction.

4. The solenoid device according to claim 3, wherein all portions of the magnetic spring overlap the fixed core side tapered surface as viewed in the axial direction.

5. The solenoid device according to claim 1, wherein the movable core is provided with a movable core side protruding portion protruding from the movable core toward the fixed core in the axial direction and suppressing deformation of the magnetic spring to the minimum spring length when the movable core is attracted to the access position.

6. The solenoid device according to claim 5, wherein the movable core side protruding portion is provided with a movable core side tapered surface overlapping at least a part of the magnetic spring as viewed in the axial direction.

7. The solenoid device according to claim 6, wherein all the portions of the magnetic spring overlap the movable core side tapered surface as viewed in the axial direction.

8. The solenoid device according to claim 1, wherein the fixed core is provided with a fixed core side protruding portion suppressing deformation of the magnetic spring to the minimum spring length when the movable core is attracted to the access position and the movable core is provided with a movable core side protruding portion suppressing deformation of the magnetic spring to the minimum spring length when the movable core is attracted to the access position.

9. The solenoid device according to claim 8, wherein the fixed core side protruding portion and the movable core side protruding portion are provided with respective tapered surfaces each overlapping at least a part of the magnetic spring, and the two tapered surfaces are parallel to each other.

* * * * *